US005560518A

United States Patent [19]

Catterall et al.

[11] Patent Number: 5,560,518

[45] Date of Patent: Oct. 1, 1996

[54] FLUID DELIVERY SYSTEM

[75] Inventors: Clive P. A. Catterall, Wantage; Ian M. D. Gaylor, Ely; William G. Dando, Coldstream, all of United Kingdom

[73] Assignee: Cambridge Consultants Limited, Cambridge, United Kingdom

[21] Appl. No.: 284,573

[22] PCT Filed: Feb. 24, 1993

[86] PCT No.: PCT/GB93/00377

§ 371 Date: Aug. 10, 1994

§ 102(e) Date: Aug. 10, 1994

[87] PCT Pub. No.: WO93/16932

PCT Pub. Date: Sep. 2, 1993

[30] Foreign Application Priority Data

| | | | |
|---|---|---|---|
| Feb. 25, 1992 | [GB] | United Kingdom | 9204133 |
| Mar. 26, 1992 | [GB] | United Kingdom | 9206655 |
| May 22, 1992 | [GB] | United Kingdom | 9210972 |

[51] Int. Cl.[6] ..... B65D 35/32

[52] U.S. Cl. ..... 222/99; 222/105

[58] Field of Search ..... 222/82, 95, 98, 222/99, 100, 101, 102, 103, 105, 336, 338

[56] References Cited

U.S. PATENT DOCUMENTS

| | | | |
|---|---|---|---|
| 1,731,703 | 10/1929 | Bourke | 222/99 |
| 2,031,671 | 2/1936 | Rising | 222/390 X |
| 2,699,889 | 1/1955 | Johnson | 222/390 X |
| 2,793,792 | 5/1957 | Pilkington | 222/191 X |
| 2,997,078 | 8/1961 | Gainer | 222/390 X |
| 3,259,276 | 7/1966 | Chase | 222/100 |
| 3,395,835 | 8/1968 | Tarran | 222/99 |
| 3,401,837 | 9/1968 | Wiedeman | 222/99 |
| 3,458,087 | 7/1969 | Cox, Jr. | 222/99 |
| 3,604,595 | 9/1971 | Wiedeman | 222/99 |
| 4,234,104 | 11/1980 | Apuzzo, Jr. et al. | 222/101 |
| 4,403,714 | 9/1983 | Kane | 222/101 |
| 4,450,982 | 5/1984 | Ferreira | 222/105 |
| 4,508,242 | 4/1985 | Wolfe | 222/102 |
| 4,551,139 | 11/1985 | Plaas et al. | 222/101 |
| 4,600,126 | 7/1986 | Arango | 222/95 |
| 4,765,512 | 8/1988 | Bull, Jr. | 222/100 |
| 5,351,860 | 10/1994 | Gotoh | 222/82 |

*Primary Examiner*—Andres Kashnikow
*Assistant Examiner*—Lisa Douglas
*Attorney, Agent, or Firm*—Lee, Mann, Smith, McWilliams, Sweeney & Ohlson

[57] ABSTRACT

Delivery apparatus for a flowable material such as toothpaste wherein a two part container is employed, thereby to form a dispenser of which one part is replaceable to renew the contents. A preferred embodiment is a sachet (450) progressively rolled up with a roll-up spring (Tensator) within a housing (418, 426) which is openable to enable the sachet to be replaced.

17 Claims, 21 Drawing Sheets

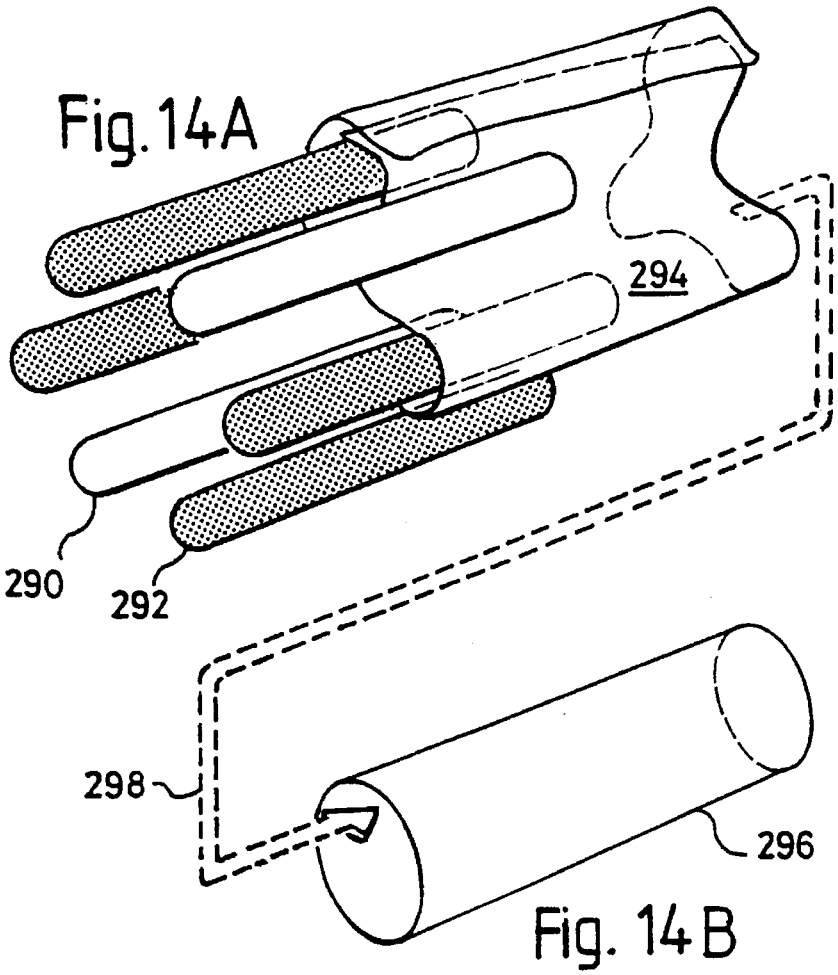
Fig. 14A
Fig. 14B
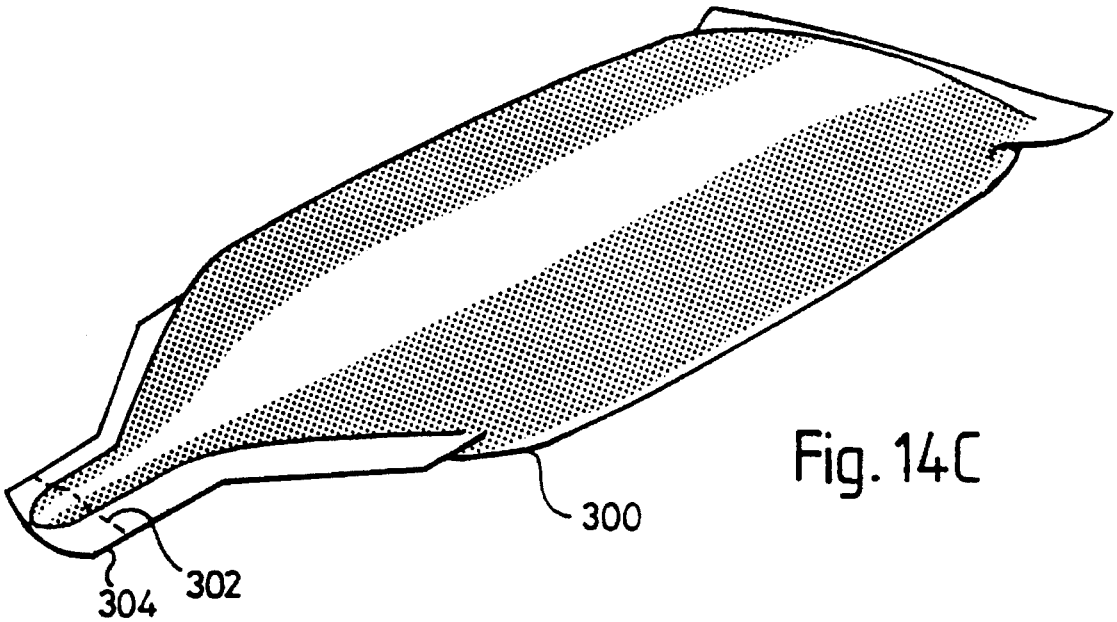
Fig. 14C

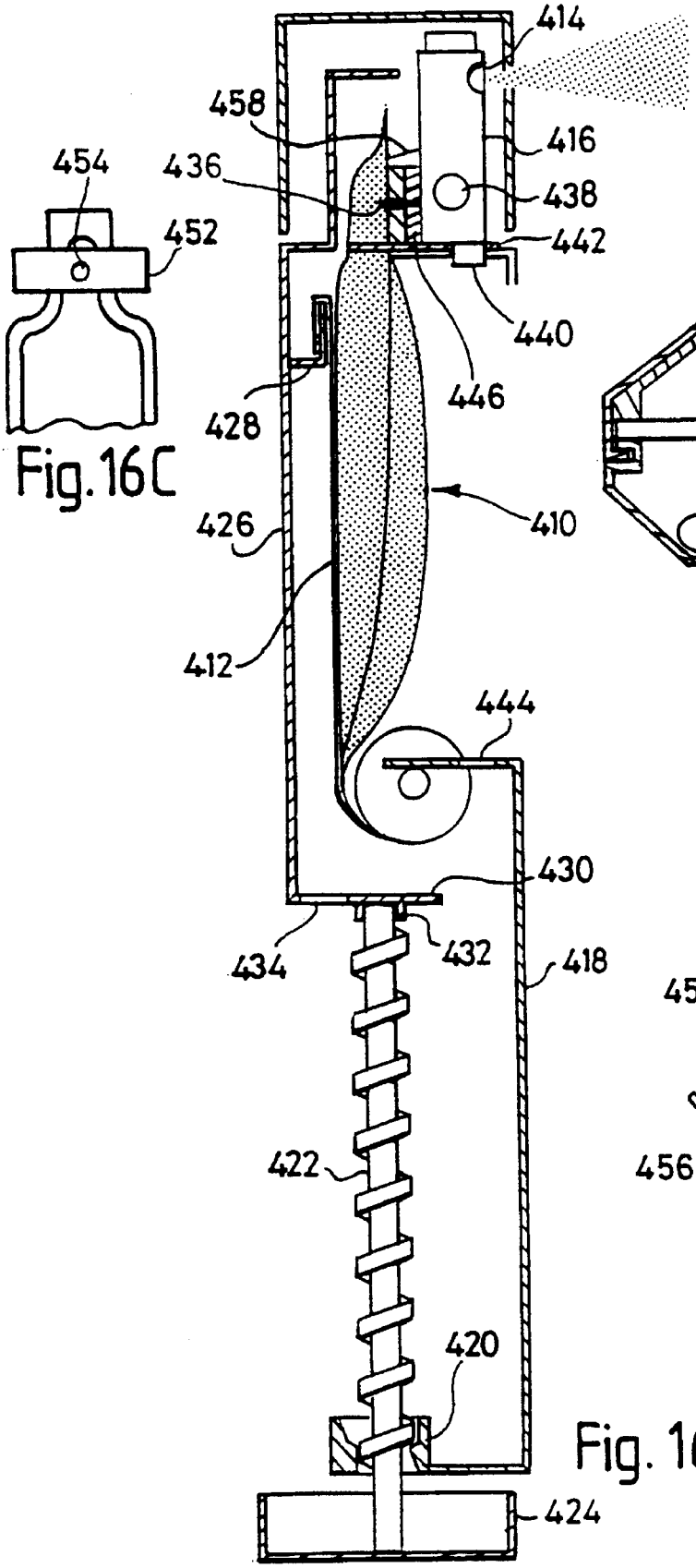
Fig. 16A
Fig. 16C
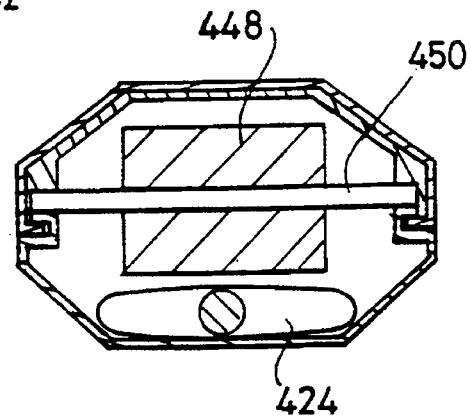
Fig. 16B
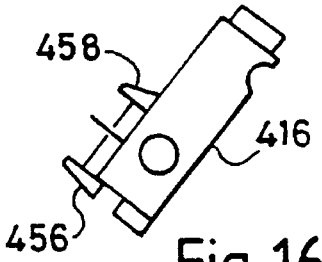
Fig. 16D

FLUID DELIVERY SYSTEM

FIELD OF THE INVENTION

The present invention relates to fluid delivery apparatus and more especially to dispensers for dispensing and delivering flowable materials such as pastes, liquids and the like from a reservoir of material by pressurising the contents of the reservoir as required to thereby expel material therefrom. The invention is of particular application to dispensers for toothpastes, soaps, creams, shampoos and the like.

BACKGROUND OF THE INVENTION

Toothpaste is commonly supplied in squeezable tubes which require a reclosable exit means typically a screw cap or snap action closure. Soaps, shampoos, hand creams and the like have been supplied in containers having trigger operated (or press down and release) pumping means for expelling the material from the container. Latterly it has been proposed to package toothpaste in containers having similar trigger operated (or press down and release) pumping means for expelling the material therefrom.

In order to dispense a fluid in the manner aforesaid a degree of pressurisation is required to force the fluid through an exit nozzle. Hitherto it has been commonplace to store the fluid in a pressurised container together with a low boiling point gas which serves as a fluid spring acting either directly or through a diaphragm onto the fluid which is to be dispensed. The need for a pressurised container tends to restrict the shape of the container. Additionally suitable low boiling point gases have either been found to be environmentally damaging or are flammable or have undesirable characteristics.

It is an object of the present invention to provide an improved dispenser for dispensing flowable materials such as toothpaste.

It is another object of the present invention to provide a dispenser into which may be fitted, throw-away containers in the form of sachets or reservoirs which when emptied can be removed and discarded to make way for a refill.

It is a further object of the invention to provide improved refills for such dispensing devices.

Yet another object of the invention is to provide an improved delivery system for fluids as aforesaid.

It is therefore still another object of the present invention to provide an alternative fluid delivery system which does not incorporate a pressurised gas and therefore does not require a pressure vessel.

SUMMARY OF THE INVENTION

According to one aspect of the present invention a dispensing device for dispensing flowable materials comprises:

1. a housing including a region defining a discharge nozzle, through which flowable material can pass,
2. support means for receiving containers which initially are filled with material to be dispensed, the support means serving to position a container relative to the discharge nozzle defining region and retain the container in position so that flowable material leaving the container exits through the nozzle defining region, and
3. means for pressurising the contents of a container situated within the support means at least when discharge of material therefrom is required.

Preferably valve means is provided for controlling the flow of material through the nozzle defining region.

The invention thus provides a two part dispenser for dispensing flowable material comprising a first part incorporating means for delivering a flowable material supplied thereto, and a second part which is operatively connectable to the first part and which at least initially contains flowable material which is to be dispensed, the second part being separable from the said first part to permit a replacement second part to be fitted.

The invention thus provides a two part dispenser in which the said first part may be re-used many times, either with a series of containers each filled with a substance to be dispensed or with a single container which is recharged from a bulk supply when empty and then refitted to the first part, the said container or refillable container comprising the said second part.

According to one embodiment of the invention, a dispenser comprises an outer sleeve and a separable inner sleeve which can be secured as by screwing into the outer sleeve, a piston sealingly engaged within the inner sleeve and slidable therein and having projecting fingers which on the one hand engage the inside surface of the inner sleeve and additionally engage the exterior of a central elongate member extending axially of the sleeve assembly, the said elongate member having an undulating external surface, and discharge is achieved by axial oscillatory movement of the elongate member during downward movement of which the sleeve engaging fingers prevent the piston from following its movement but during upward movement thereof the other fingers lock onto the said undulating external surface of the elongate member causing the piston to follow the upward movement thereof, the said sleeve engaging members permitting movement in the upward direction. Flowable material such as paste situated within the sleeve and above the piston is thereby pressurised with oscillatory movement of the central member causing the said material to be expelled upwardly from the sleeve to fill a cavity within a discharge head which feeds the flowable material to an exit nozzle.

Conveniently at least part of the discharge head is movable relative to the upper end of the said sleeve assembly so as to permit up and down movement to be transmitted to the said elongate member to effect pressurisation and expel the flowable material from within the said inner sleeve.

The undulating surface is preferably formed as a helical thread so that the piston can be unscrewed from the central member after use, to permit the empty internal sleeve to be separated, complete with piston, from the said outer sleeve and discharge head, to thereby enable the inner sleeve to be replaced by a filled sleeve.

Typically the inner sleeve is threadedly engaged within the outer sleeve to achieve the said securing of the two sleeves.

Typically each filled sleeve includes a tear-off foil top which is removed just before the filled sleeve is to be inserted into the outer sleeve. As the filled inner sleeve is slid into the outer sleeve the elongate member passes into and through the contents thereof and passes through an aligned aperture in the piston, which in the filled inner sleeve constitutes the lower end thereof.

In another embodiment the pump action is reversed in that the central elongate member remains stationary and the piston engaged thereon is caused to rise from the lower start position within the inner sleeve towards the upper end thereof by successively moving the inner sleeve up and down relative to the said stationary elongate member, the piston having secured thereto resilient fingers which engage both the inside surface of the inner sleeve and the said elongate member in such a manner that when the inner sleeve is moved in a downward direction the piston is prevented from moving downwards by the engagement of some of the fingers with the elongate member but is caused to rise with the inner sleeve as the latter slides in an upward sense the engagement between the other fingers and the elongate member permitting upward movement of the piston.

As with the first embodiment the refill may comprise a sleeve having a foil cap, and the discharge head associated with an outer sleeve into which the inner sleeve is fitted, includes means for piercing the foil or other membrane stretched across the upper end of the inner sleeve to enable flowable material contained within the inner sleeve to exit into a cavity within the discharge head as it is pressurised with up and down movement of the inner sleeve relative to the stationary elongate member.

The overall assembly of this second embodiment requires an outer sleeve attached to the discharge head and a base associated with and secured to the elongate member, the base being adapted to be secured as by screw threaded engagement with the said outer sleeve. The base and inner sleeve are conveniently splined together so that the base can be used to screw the inner sleeve into position as well as permitting the normal pumping action.

In a further embodiment again comprising inner and outer sleeve and a discharge head secured to and communicating with the external sleeve, two pistons are provided, one associated with the discharge head and movable with a relatively small stroke in an up and down manner within the upper end of the inner sleeve when the latter has been fitted into the outer sleeve, and a second piston which initially forms the base of the inner sleeve remote from the discharge end and which with successive pumping of the upper piston is caused to travel up the inside of the inner sleeve to pressurise and discharge the flowable material located thereabove. As with the previous embodiment, one way fingers are provided which extend into engagement with the internal surface of the inner sleeve from the said second piston such that the latter can slide upwardly but is prevented (by engagement of the fingers with the internal surface of the inner sleeve from moving downwardly). In order that flowable material within the inner sleeve can exit therefrom, the upper piston is provided with at least one aperture through which material can pass as the material between the two pistons is pressurised.

A non-return valve may be provided so that material can only flow through the upper piston during a down stroke and as the lower piston is prevented from moving in a downward direction away from the first piston, the downward movement of the upper piston charges the space above the upper piston with flowable material. As the upper piston rises the lower piston is sucked up the internal sleeve to compensate for the reducing volume of material between the two pistons thereby causing material which has been forced into the space above the upper piston to be dispensed through a discharge nozzle as the upper piston rises and pressurizes the material thereabove.

It is a feature of this third embodiment that the refill device is in the form of a sleeve in which the upper end is adapted to fit over the upper piston which is held captive within the outer sleeve at the internal end thereof and is movable therewithin in response to a pumping action applied to the discharge head or a push-button associated therewith.

In a fourth embodiment which is substantially similar to the third embodiment, the outer sleeve is dispensed with and the outer sleeve is adapted to be secured to a collar at the lower end of the discharge nozzle assembly which defines a cavity within which the upper piston is located. Typically the inner sleeve (which forms the outer wall of the refill cannister) is securable to the said collar by means of a screw thread engagement between the two members. As before oscillatory movement of the piston in combination with the finger engagement of the lower piston with the internal wall of the refill sleeve causes the lower piston to progressively move up the refill sleeve as flowable material is removed therefrom, through the upper piston, and discharged in the manner previously described.

The fitting of the refill sleeve to the collar of the discharge nozzle assembly may be by way of a screw thread or a bayonnet fitting or any other relatively quick release coupling which nevertheless produces a good seal between the two parts so that pressure built up within the space between the two pistons is available to discharge flowable material through the upper piston.

According to a further embodiment o the invention, an inner sleeve is again received within an outer sleeve at the upper end of which is located a pump action discharge head and nozzle and a piston is provided within the inner sleeve again with fingers engaging the internal surface of the inner sleeve so that the piston is capable of sliding movement so as to progressively move up the inner sleeve but not in a downward direction, and the upper piston of the previously described embodiments is replaced by means of a flexible diaphragm at the upper end of the inner sleeve and means is provided associated with the pump action nozzle to deform the said diaphragm in a downward direction and cause material within the inner sleeve to be pressurised and thereby pass through a tubular conduit which is adapted to penetrate and seal against the diaphragm during fitting of the internal sleeve, relaxation of the pumping means enabling the flexible diaphragm to resume its normal position thereby causing a reduction in pressure in the flowable material within the inner sleeve so that the piston at the lower end thereof is caused to be drawn upwardly into the sleeve to compensate for the reduction in volume as material is forced through the conduit into the discharge head and out through the nozzle.

In this last mentioned embodiment the upper flexible end wall of the refill serves as a diaphragm instead of using an upper piston. Preferably external features are provided on the conduit which are gripped by the diaphragm so as to provide a good seal between the diaphragm and the external surface of the conduit, and the pump action within the discharge nozzle serves to move the conduit into and out of the said inner sleeve in an upward and downward direction.

It is a characteristic of all of the embodiments described so far that the inner sleeve is either maintained generally rigid either by its own inherent strength or by virtue of a bounding wall provided by the outer sleeve into which it is fitted. In a sixth embodiment of the invention, this characteristic of the inner sleeve is dispensed with and instead a flexible walled sleeve is employed in the form of a so-called rolling diaphragm the internal surface of which is provided with a plurality of ratchet teeth extending either completely or partly around the internal surface thereof, and the lower end of the sleeve is more rigidly formed than the remainder of the wall section so that the lower end acts in the form of piston and the upper end of the sleeve is adapted to be secured to a pump action device having a non-return valve so that with downward movement the contents of the inner sleeve are pressurised and caused to be forced under pressure through the non-return valve into the cavity within the discharge device to flow through to the exit nozzle, and on upward movement of the said pump action device, the contents of the inner sleeve are depressurised to such an extent that the base of the rolling diaphragm is sucked into the inner sleeve. Successive pumping causes further progressive movement of the base into the inner sleeve until the ratchet teeth on the internally opposed faces of the rolling diaphragm engage thereby preventing downward movement of the lower end of the sleeve during the next pressurisation of the contents thereof. Successive pressurisation and depressurisation of the contents causes the lower end of the rolling diaphragm sleeve to migrate upwardly as material is expelled so as to compensate for the reducing volume of material within the sleeve, each progressive movement of the lower end upwardly causing the ratchet teeth to ride over one another for a fresh engagement of ratchet teeth to be achieved, thereby continuing to prevent downward movement of the lower end of the sleeve during the next pressurisation step.

Preferably the ratchet teeth formed in the inside surface of the rolling diaphragm extend completely around the inside surface of the sleeve so that there is no tendancy for the upwardly progressing base of the sleeve to be distorted when subject to each increase in internal pressure.

The non-return valve may be formed in the upper end of the inner sleeve or may be formed by a non-return valve within the conduit leading from the upper end of the inner sleeve to the exit nozzle or may be formed by means of relatively sliding parts of the said inner sleeve and the pressurising device so that downward movement of the latter results in the non-return valve being opened and upward movement results in the non-return valve being closed.

In this last mentioned arrangement the refill element requires a rigid outer sleeve which may be formed from plastics or metal or strengthened cardboard and a permanent connection between it and the upper end of the rolling diaphragm inner sleeve, is preferably provided.

As before a tear-off foil top may be provided which is removed before the discharge head is fitted, or the latter may include a penetrating knife edge which removes the foil as the head is fitted to the refill.

In another embodiment of the invention similar to the last mentioned embodiment, the non-return valve may be formed by a thin walled rubber tube which surrounds a solid spigot formed within a moveable upper cap, the thin walled tube forming the conduit between the pressurisable contents of the sleeve and a cavity within the discharge head leading to a discharge nozzle, and the action of pressing down the head and pressurisation of the contents of the sleeve is sufficient to expand the thin walled tube to permit the egress of flowable material under pressure through the annular space so created between the thin walled tube and said projection, subsequent upward movement of the head causing depressurisation of the contents and permitting the thin walled tube to revert to its normal state to grip the projection and seal off the contents of the inner sleeve from the cavity.

Preferably the thin walled tube is formed from rubber or a resilient plastics material or combination thereof.

In a still further embodiment the downwardly moveable plunger is caused to depress a flexible diaphragm across the upper end of the inner tube to thereby pressurise the contents of the latter and the diaphragm includes a central upwardly extending thin walled tube within which a plug member is slidable, the latter having a groove in its external surface to permit flowable material to flow under pressure to a point just below the upper rim of the thin walled rubber tube surrounding the said plug, and with continued rise in pressure to distort the said thin walled tube away from the surface of the plug and permit the material to escape under pressure. It is an advantage of such an arrangement that as soon as the pressure drops the tube resumes its normal smaller size due to its elasticity thereby shutting off the upper end o the passage through the plug and preventing air from reaching even the material trapped within the groove in the wall of the plug. Many flowable materials particularly materials such as tooth paste deteriorate when in contact with the air and by providing the valve means at the exit end of the nozzle so contamination and deterioration of the flowable material is reduced to a minimum.

In general, in all embodiments of the invention in which a piston or sachet "end" is progressively "walked-up" a sleeve if a non-return valve is not present the viscosity of the flowable material must be such that on depressurisation the force dragging the material back out the sachet is less than that acting on the piston or sachet end, so that the latter moves preferentially in an upward direction.

According to a second aspect of the invention, a dispenser for flowable materials comprises a housing adapted to receive a flexible sachet of flowable material and including prong means which in use exerts a force on the sachet to expel material therefrom and valve means is provided to prevent the exit of the material from the sachet except when the valve is opened. One embodiment of this aspect of the invention provides a generally elongate housing having an upper half which is slidable rearwardly relative to the lower half to expose a chamber therewithin into which a sachet of flexible material containing flowable material to be dispensed, can be fitted, and providing as it is moved to expose the chamber, means for unrolling a self roll-up spring such as a Tensator (Registered Trade Mark) spring, the free end of which is attached near the one end of the housing away from which the slidable housing member is move to retract the spring, and valve means is provided at the said one end of the housing which normally prevents the flow of material from the sachet but which can be opened by depressing a button, so that when the relatively movable housing member parts have been relocated and the spring is freed to revert to its curled up condition, and thereby pressurise the contents of the sachet, material will flow therefrom when the said valve is opened.

Conveniently the captive end of the said spring provides a movable anvil, and a member within the housing forms a second fixed anvil, and, if a sachet is not present the spring and anvil is urged tightly against the fixed anvil. The release button preferably includes a bifurcated end for straddling the sachet in order to press down on the spring where it extends between the its said anvil end and that point along the length of the spring which is held captive by being secured to the housing to enable the anvil to be pushed away from the upper anvil. By pressing down on the release button, so an end of the sachet (defining an exit for the sachet contents) can be pinched below the two anvils. After releasing-the button, the protruding sachet end can be cut and thereafter, once the spring is enabled subsequent depression of the button will permit the material within the sachet to expand flow through the end of the sachet normally trapped between the two anvil members, to enable the method to be dispensed whilst the button is depressed.

The parts of the housing defining the exit nozzle may include a sharp or serrated edge so that the sachet material can be ripped relative to the edge after the sachet has been installed thereby enabling a sachet, supplied as a sealed container to be opened only after it has been installed and pressurised to thereby reduce the risk of the ingress of contaminating material.

According to a third aspect of the invention a sachet similar to that envisaged in the previous embodiment may be situated within one half of a suitcase-like housing formed from rigid or semi-rigid material forming two shells hinged along one edge, which can be hinged into a first position, which is such as to permit further movement of the housing shells towards each other, so that as they are squeezed together from the closed position, the sachet is also squeezed so as to pressurise its contents, to expell the latter from the sachet through a nozzle formed at one end thereof.

Typically the sachet is supplied in a sealed condition and a nozzle end thereof is adapted to extend through an end wall of the housing into a nozzle defining section of the housing to be severed after the sachet is in place, to allow the contents to be expelled therethrough, when the housing is squeezed.

According to a preferred feature of this last aspect of the invention the interior of one or both of the shells forming the housing may be at least in part filled with a foamed material and according to a further preferred feature the foamed material is shaped so that the space available for a sachet between the cooperating surfaces of the foamed material is less at one end than at the other when the two housing halves are closed together, so that as the two halves are progressively squeezed the sachet is preferentially squeezed at one end rather than the other so as to progressively expel the contents from the sachet from the closed end thereof toward tire open end containing the exit nozzle. In addition or alternatively hard and soft foamed material may be employed so as to accommodate different regions of the sachet.

In order to prevent accidental squeezing of the two housing halves (for example when the unit is packed in luggage), an outer rigid sleeve may be provided adapted to be fitted over the housing and the inside surface of the sleeve is adapted by means of ribs or other stop members to prevent the two housing halves from being squeezed together. The outer sleeve may be formed from two or more parts which can be separately slid over the main housing halves and may be secured as by a snap fit together so as to form an elongate rigid outer casing. One end region may be removable so as to expose the exit nozzle and part of the two housing shells which can then be gripped between finger and thumb and squeezed sufficiently to expel more of the contents of the sachet before the protective end cap is refitted.

This last mentioned embodiment is of particular use for toothpaste and hair shampoo and the like although it is by no means restricted to such applications.

Although for many purposes the material to be dispensed is a unitary material and substantially homogeneous there are situations where two or more dissimilar materials are to be dispensed together as for example in the case of toothpaste in which differently coloured toothpaste materials are expelled simultaneously through an exit nozzle so as to provide striped toothpaste. The stripe of different material may be for purely cosmetic or marketing purposes although in some situations a second ingredient such as a chemical additive is incorporated into one of the materials which may or may not be differently coloured from the base material and the two materials are caused to be expelled simultaneously in appropriate proportions so that the chemical additive appears in the base material during dispensing, in the correct proportions. Dispensing additives in this way ensures that the relative proportions are maintained substantially constant throughout the life of the dispenser, something which would otherwise not be guaranteed if the additive and base material were mixed together in the container, in which event the constant proportions would only be achieved if the container were shaken vigorously before each dispensing.

According therefore to a further aspect of the present invention, a container for use with a dispensing device for containing a flowable material such as a paste or the like is formed with two or more separate compartments each of which is separately fillable so that different materials can be stored within the same container and each of the compartments includes an exit passage which merges with the exit passages of the other compartments to form a single exit nozzle through which the contents of the separate compartments are simultaneously expelled if the contents of the different compartments are all subject to a uniform expelling force, thereby to produce a striped extrusion from the exit nozzle if differently coloured materials are employed.

In one arrangement for example, red coloured toothpaste may be contained in one compartment, white in another and blue in a third, and the merging of the three exit passages into the exit nozzle maintains the relative positions of the three streams of differently coloured paste so that as the paste is expelled from the final exit nozzle, it does so in the form of three layers, one blue, one white and one red.

Where the container is in the form of a flexible socket, the different compartments may be formed by seam welding the sachet to form two, three or more elongate compartments Which may extend along the length thereof with the separate compartments tapering in cross-section towards an exit end to define a common nozzle.

Alternatively the compartments may be formed by means of membrane-like divisions located between the upper and lower flexible shells of the sachet so that each compartment lies above or below another in the form of a sandwich within the container each extending from one end to the other thereof, each layered compartment so formed communicating via a tapering cross-section exit passage to communicate with the others in a common exit nozzle.

In a further arrangement the separate compartments may be located one after another along the length of the sachet in which event the exit from each compartment may either communicate with a common manifold (which itself communicates with a common exit nozzle), an aperture between each compartment and the manifold determining flowrate for material therefrom into the manifold and being selected so as to ensure that the flowable material entering the manifold does so in the correct proportions from each of the separate compartments; or alternatively each compartment may feed a separate passage each of which includes a right-angled bend so that the two or more passages communicating with the different compartments end up as parallel spaced apart passage in an edge region of the sachet each of feeds a common exit nozzle so as to separately feed different regions of the exit nozzle to achieve a striped effect on being expelled through the nozzle, if differently coloured materials are employed.

In a further embodiment, three coloured lengths of generally self-supporting paste may be wrapped defined by a length of sheet material (which may be wrapped around the exit nozzles of an extruder and therefore the paste extruded therefrom so as to alternately outlie and underlie the nozzles so that the extruded lengths of differently coloured material are separated one from the other by means of the sheet material) and the whole assembly is enclosed within a sleeve of sheet material into which it is slid, or which is formed by wrapping a length of sheet material around the whole assembly, before it is located within a collapsible container, one end of which tapers from an exit nozzle, and which if squeezed will cause the differently coloured materials to extrude collectively through the exit nozzle and produce a striped effect in the expelled product.

The multiple compartment containers described above are most conveniently in the form sachets of generally flexible sheet plastics material or rubber and plastics composite. Such sachets are generally not self-supporting and for marketing purposes would typically be located within a cardboard or other supporting package or tube which may be discarded when the sachet is inserted into a dispensing device.

Generalising the above described second aspect, the invention also provides a fluid delivery system comprising:

(a) housing means (b) a variable volume reservoir located therein (c) valve means for controlling the flow of a fluid contained within the reservoir through an outlet nozzle (d) spring means within the housing acting on the reservoir to pressurise the contents thereof so that when the nozzle valve is opened the contents are forced therethrough.

In one embodiment the reservoir comprises a sachet acted on by spring means (a so-called Tensator spring) and the cannister includes means for retracting the Tensator spring to permit the insertion of a filled sachet and further includes means for releasing the retraction means to enable the spring to curl up and pressurise the sachet.

The cannister of this first mentioned embodiment typically includes sachet retention means remote from the curled-up end of the Tensator spring together with means for piercing the sachet and providing a fluid exit therefrom leading to valve means and an exit nozzle. Sealing means is conveniently provided around the piercing means so that fluid from within the sachet cannot escape except through the exit passage established by the piercing.

The spring retraction means may simply comprise a plunger having a handle externally of the cannister which can be pulled in a rearward direction to retract the Tensator spring ie extend the spring. Alternatively and preferably a threaded plunger is employed which can be rotated so as to draw the Tensator spring rearwardly within the housing to retract same.

The device preferably thus comprises a two part housing which is openable to enable sachet replacement. The sachet is itself preferably rolled up with the spring during use.

Thus, the two parts of the housing are preferably relatively displaceable in the direction in which the spring rolls up and unrolls, and displacing one part relative to the other to open the housing for sachet replacement automatically unrolls the spring so that it will pressurise a replacement sachet when the housing is subsequently closed. The roll-up spring then has one end fixed to the first part of the housing carrying the nozzle defining means and at the other end has a curled portion engaged and displaced by the second part of the housing when the latter is displaced relatively to the first part to open the housing.

The device preferably has a finger-operable accessible element such as a push-button for opening the nozzle-defining means. Conveniently, the finger-operable element may act to open apart two movable jaws which, when closed together, grip and close the end of the sachet through which fluid emerges in use.

The device preferably has, inside the housing, a member for limiting distortion of the sachet adjacent the movable jaws.

The curled-up end of the spring is preferably mounted on a drum which has wheels running on guides in the closed housing. Conveniently, the wheels may be guided for movement in the direction of the housing in which the spring rolls up and unrolls. In association therewith, the core of the drum is preferably made of compliant material to assist guiding of the drum and thereby ensure uniform compression of the sachet across its width.

Preferably, in order to enable use of a sachet wider than the drum and spring, the ends of the drum have flanges between which the wider sachet is constrained to roll up as the spring progressively rolls up in use.

The invention will now be described by way of example with reference to the accompanying drawings in which:

FIGS. 12 to 15 illustrate different refillable sachets which may be used with some of the dispensers shown in FIGS. 1 to 11 and are adapted to contain different materials and dispense same simultaneously as in the case of striped toothpaste;

FIG. 16 shows an embodiment of fluid delivery system in accordance with the invention.

Figure 1A:
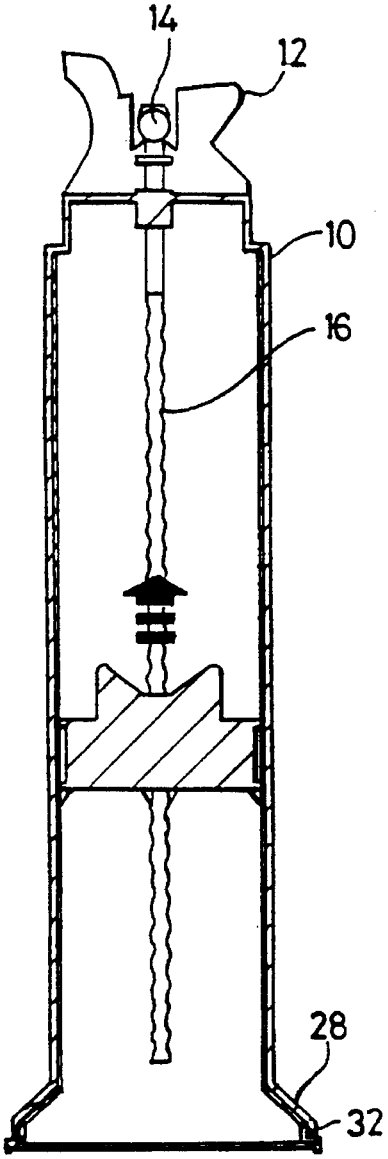
FIGS. 1 to 11 illustrate different forms of construction of dispensing devices in accordance with the invention.

FIG. 1A is a cross-section through a first dispenser comprising an outer cylindrical shell 10 having a conventional flexible cap 12 which grips the upper ball end 14 of a central rod 16 which has an undulating external surface over the majority of its length. The dispenser is charged with a paste or other flowable material such as 18 contained within a second cylindrical sleeve 20 the upper end of which is covered by a tear-off foil 22 and the lower end of which is closed by means of a piston 24. The extreme lower end of the sleeve 20 is formed with a flared flange 26 which corresponds to a similarly flared flange 28 at the extreme lower end of the outer sleeve 10. A screw thread profile 30 in the inner flare and a complimentary screw thread profile 32 in the outer flare enables the inner sleeve to be screwed into and retained in the outer sleeve.

The inner sleeve 20 comprises a refill for the dispenser shown in FIG. 1A. To insert the refill the foil 22 is first removed and then the sleeve 20 is slid into the sleeve 10. The central rod 16 passes through the material contained within the sleeve 20 and extends through a hole (not shown) formed centrally of the piston 24. The final act of insertion comprises the step of screwing the inner sleeve relative to the outer sleeve so as to form the assembly as shown in FIG. 1A.

Figure 1C:
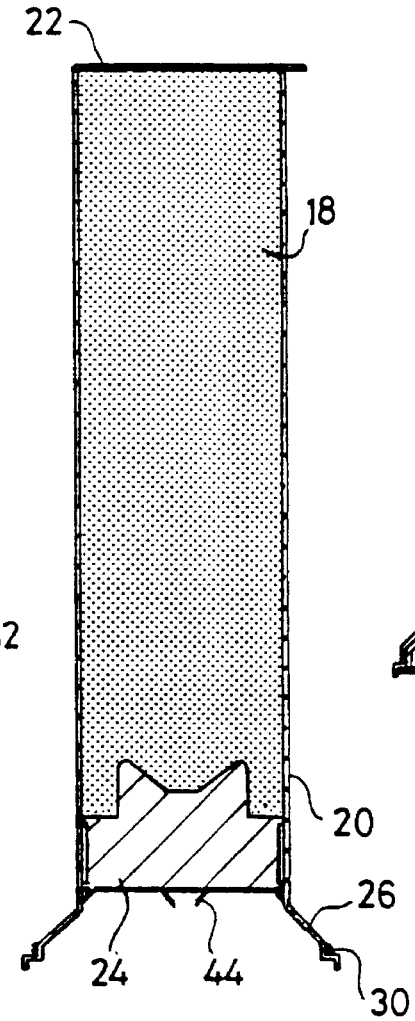
Figure 1B:
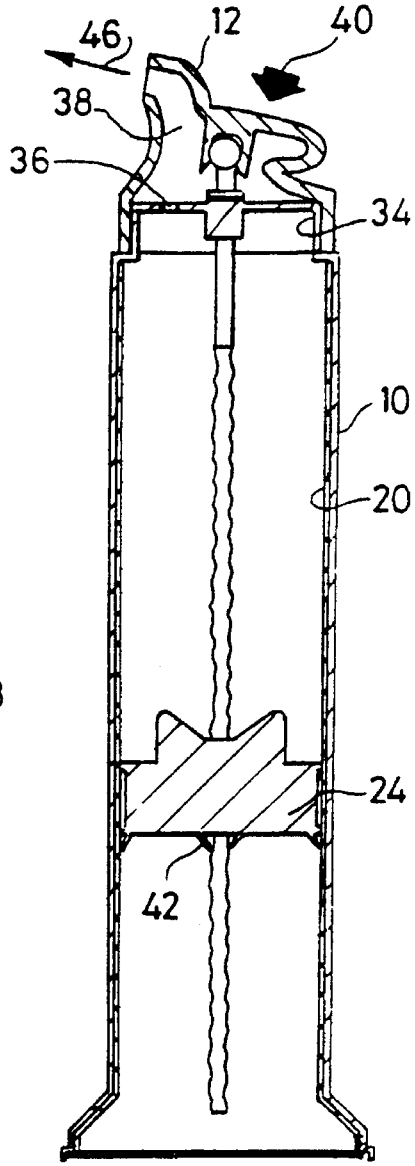

The contents of the refill can be discharged through the flexible cap 12 in a manner which is best seen with reference to FIG. 1C. The upper end of the outer sleeve 10 is closed by means of a cap 34 over which the flexible upper cap 12 is fitted. As will be seen in the cross-section in FIG. 1C, the end wall of the cap 34 is apertured in one or more places as at 36 to permit paste such as 18 contained in the refill 20 to pass into the upper region 38 of the upper cap. This is achieved by depressing the cap in the direction shown by the arrow 40 in FIG. 1C so that the rod 16 is moved in a downward direction relative to the sleeves 10 and 20. The provision of a double star lock washer 42 on the underside of the piston 24 permits the downward movement of the rod 16 whilst preventing downward movement of the piston 24. It will be noted that the star lock washer fingers engage against the internal surface of the inner sleeve 20 and prevent downward movement of the piston but the similarly downwardly inclined fingers 44 (see FIG. 1B) engage the rod 16 in such a way that relative movement of the rod in a downward direction is permitted but not in the reverse direction.

When the pressure is removed from the upper end of the rod 16, the resilience of the cap 12 causes the rod to lift and in doing so the piston travels with the upward movement of the rod by the distance through which the rod moves in an upward sense. Essentially this is the same distance that the rod was pushed down. The upward movement of the piston causes the volume of the inner sleeve to be reduced and causes paste 18 to be expelled through the aperture 36 into the upper part 38 of the cap 12. Repetitive pumping of the rod 16 eventually causes the upper compartment 38 to become filled with the paste or other fluid below the cap 34 and it is finally expelled through the exit nozzle in the direction of the arrow 46.

By forming the external surface of the rod 16 with a coarse screw thread, the fingers 44 of the double star lock washer assembly will grip the thread and this may cause rotation of the piston as it rises progressively up the inner sleeve. Whilst this is of no particular relevance during the dispensing of the fluid, the rotational movement can be employed to advantage when the pack is empty since by simply unscrewing the outer sleeve and continuing to turn the inner sleeve relative to the outer sleeve after the two have become unscrewed, enables the piston to be unscrewed from the central rod and allow the inner sleeve to be fully detached from the outer sleeve. The dispensing device is then in a condition ready for a fresh refill to be fitted as previously described.

Figure 2A:
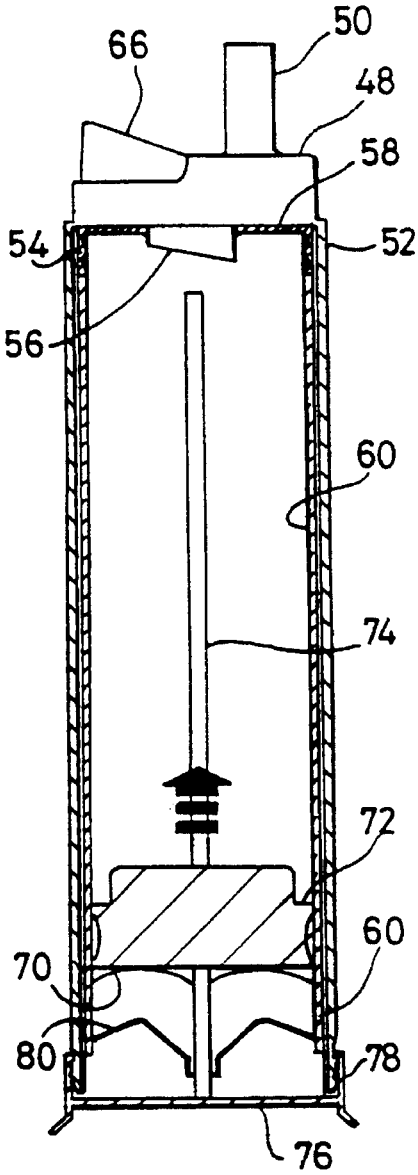

FIG. 2A illustrates a similar pump action dispenser in which a relatively rigid cap 48 in exit nozzle 50 comprises the upper end of an outer rigid tube 52 and includes a displaceable cap 54 having a central tube 56 the lower edge of which is adapted to pierce a membrane 58 stretched across the upper end of an inner refill 60 containing a paste or other fluid 62. The displaceable part 54 is adapted to be screwed or otherwise secured to the upper end 64 of the refill shown in FIG. 2B.

Figure 2B:
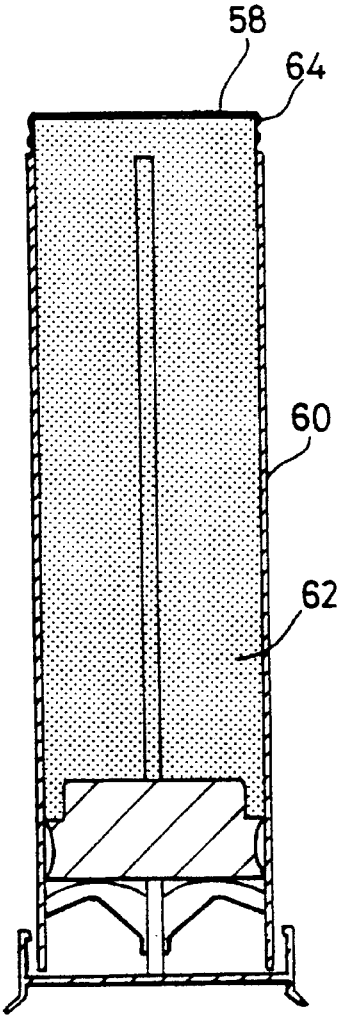
Figure 2C:
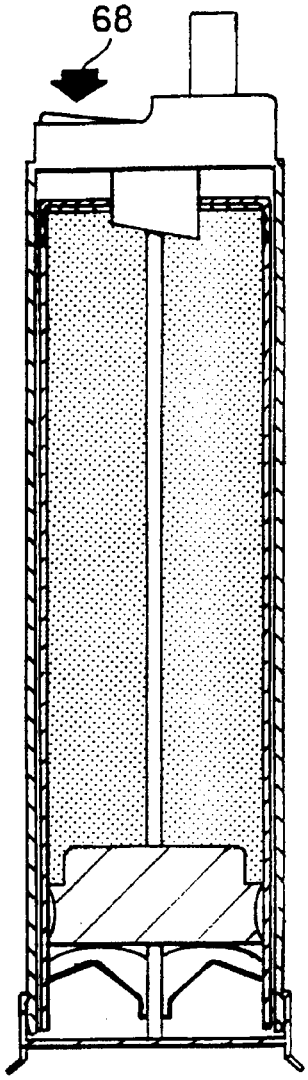

Pumping to expel paste 62 through the exit nozzle 50 is effected by moving the inner sleeve 60 up and down by depressing a button 66 which is spring loaded in the upward direction to occupy the position shown in FIG. 2A but can be depressed in the direction of the arrow 68 into the position shown in FIG. 2C. When the sleeve is pushed down as is the case in FIG. 2C, the star lock washer assembly 70 below a piston 72 received on a central rod 74 within the sleeve 60 causes the piston to grip the rod so that the piston does not follow the downward movement of the inner sleeve 60. However, when the inner sleeve 60 is caused to rise as the pressure on the button 66 is released, the action of the star washer is reversed and the piston rises with the sleeve. This upward movement reduces the available volume for paste or other fluid 62 in the space above the piston causing the material to be pushed through the tube 56 and out through the nozzle 50. Passages communicating between the tube 56 and the nozzle 50 are not shown.

The rod 74 is secured in position by means of a plate 76 having a cylindrical surrounding sleeve 78 which is adapted to be latched to the lower end of the outer sleeve 60 when the unit is assembled.

The rod 74 and base 76 are secured to the inner sleeve 60 by means of a diaphragm or other arrangement shown at 80.

Figure 3A:
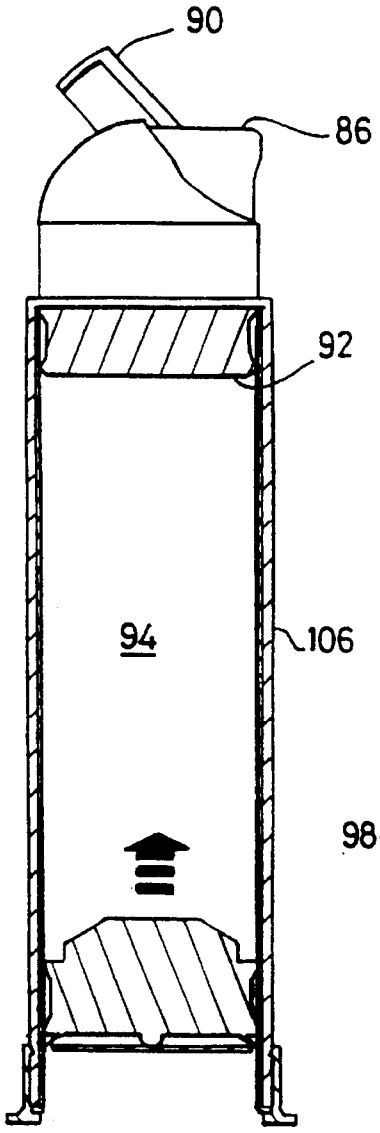
Figure 3C:
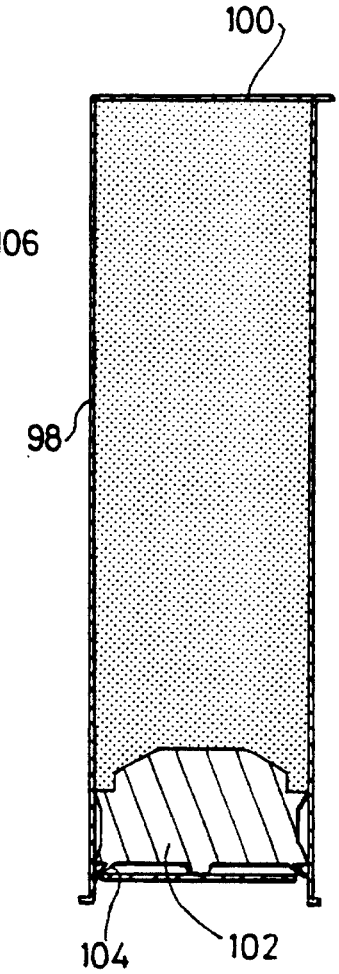

In FIG. 3 another dispenser is shown having a rigid upper cap 82 with a discharge nozzle 84, and a push-button 86 which is spring loaded into the position shown in FIG. 3A and which can be depressed into the position shown in FIG. 2B by pressure in the direction of the arrow 88. Movement of the button 86 in a downward direction moves a cover flap 90 in a clockwise direction from the position shown in FIG. 3A in which the far end of the cover closes off the exit of the nozzle 84 into the position shown in FIG. 2B leaving the nozzle clear.

Figure 3B:
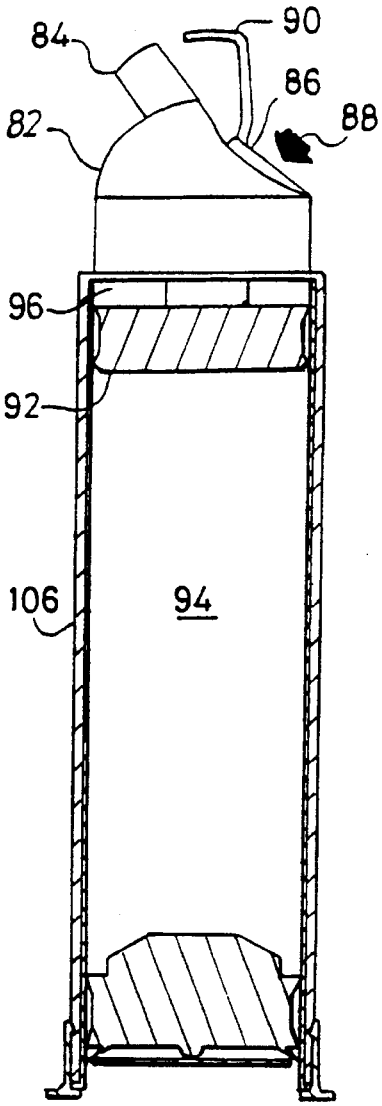

Within the head 82 a mechanism provides for downward movement of another piston 92 in response to downward movement of the button 86 so that the upper piston 92 is displaced from the position shown in FIG. 3A to the position shown in FIG. 3B at the bottom of the stroke of the button.

Piston 92 includes at least one aperture (not shown) through which paste from space 94 can pass to the space 96 above the piston as the piston 92 is moved in the downward sense. Passage means within the head 82 communicates with the nozzle 84 so that paste displaced into the space 96 will eventually under sufficient pressure exit through the nozzle 84.

In common with the other dispensers already described, the paste is contained within an inner tube 98 the upper end of which before use is covered by a tear-off foil 100 and the lower end of which is closed by a piston 102 having a star lock washer 104 situated on its underside engaging the wall of the inner tube 98.

The external diameter of the tube 98 is commensurate with the internal diameter of the outer tube 106 which extends from the head 82 and the tube 98 is loaded into the dispenser by first removing the foil 100 and then sliding 98 into 106 to occupy the position shown in FIGS. 2A and 2B.

Insertion of the tube 98 causes the piston 92 contained at the upper end of the sleeve 106 to enter the tube 98, the aperture therein permitting paste to be displaced through the piston into the head 82.

The star lock washer 104 on the piston 102 prevents the latter from moving downwards but permits upward movement of the piston 102. Consequently whilst downward movement of piston 92 pressurises the paste 94 and would normally push the piston 102 lower or even out of the tube 98, the star lock washer prevents this happening and instead the paste is forced upwardly as previously described through the apertures or apertures in the piston 92 into the space thereabove.

Releasing the button 86 causes the piston 92 to rise upwardly under the action of the spring associated with the button 86, and the increase in the volume below the piston 92 results in a depression in the pressure therewithin causing the piston 102 to rise to commensurate. Continued pressing and releasing of the button 86 causes the lower piston 102 to progressively advance up the tube 98 as paste is displaced from the region below the upper piston to the space above it.

When the refill is empty the lower piston will be in contact with the upper piston. The tube 98 can be removed from the outer sleeve 106 and discarded and replaced by a filled refill similar to that shown in FIG. 3C.

Figure 4A:
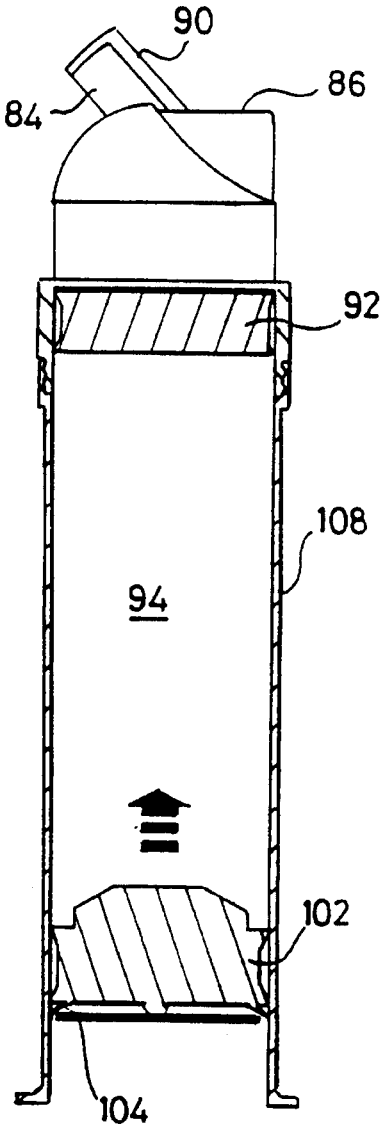
Figure 4C:
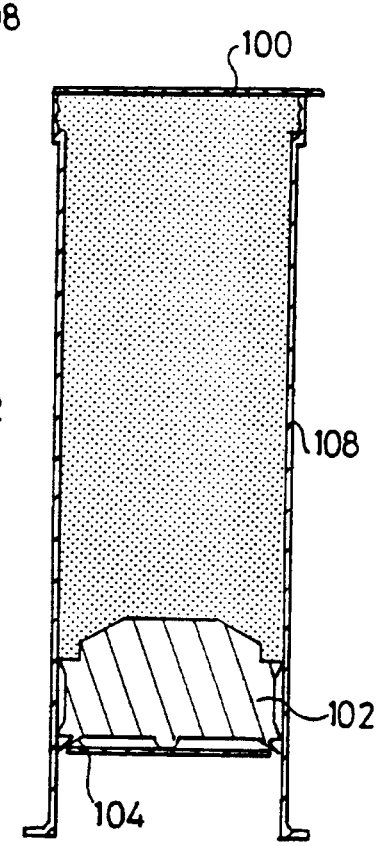
Figure 4B:
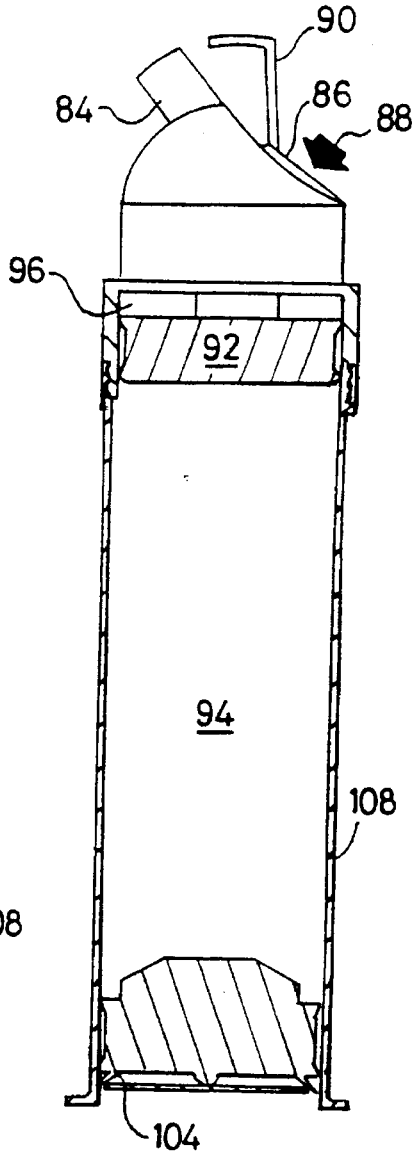

FIG. 4 is essentially the same as the embodiment shown in FIG. 3 to which end the common parts are referred to by using the same reference numerals as in FIG. 3. The chief difference between the arrangements is that whereas in FIG. 3 the inner sleeve of the refill is surrounded by the rigid outer sleeve 106, in FIG. 4 the refill is itself formed with a rigid wall and is denoted by reference numeral 108 and is adapted at its upper end to be screw threadedly secured to the base of the cap 82 by engagement with a threaded end thereof.

Figure 5A:
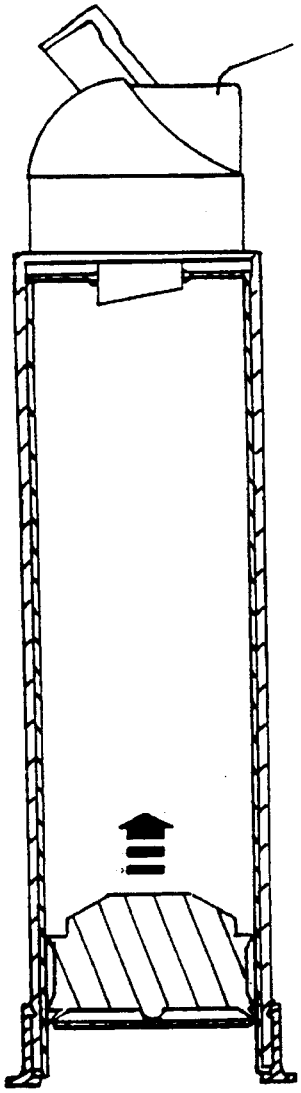
Figure 5C:
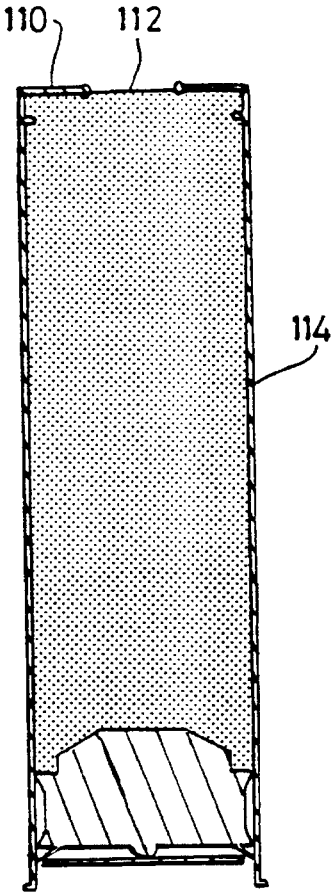
Figure 5B:
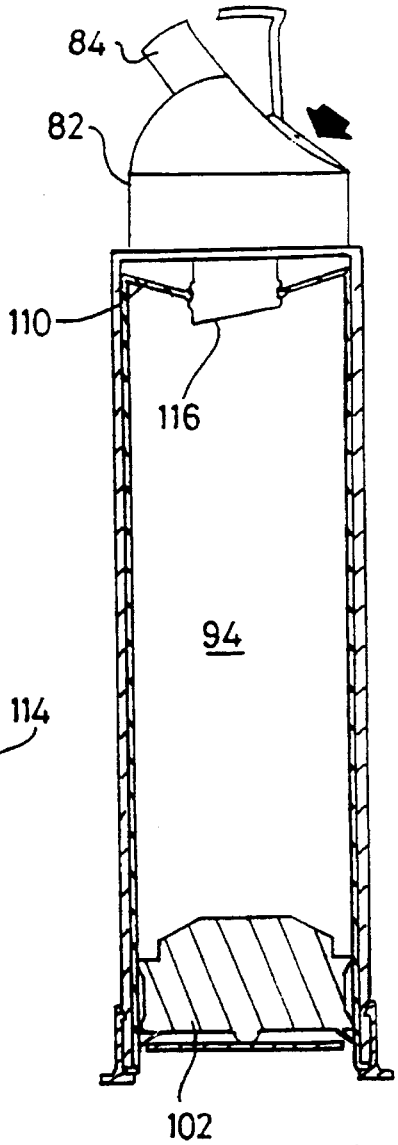

FIG. 5 is again similar to the FIG. 3 and FIG. 4 embodiments in that the cap operates substantially in the same way, as do the lower piston and inner sleeve. However instead of a second piston such as 92, the upper end of the refill is formed with an annular flexible diaphragm 110 with a thin membrane 112 closing the central aperture in the membrane 110 until the refill denoted by reference numeral 114 is ready to be inserted into the dispenser.

The head 82 includes a tubular communicating and piercing member 116 which moves downwardly under the action of the button 86. The diaphragm 110 sealingly fits around the member 116 so that the diaphragm moves with the tubular member 116.

Depressing the button 86 results in a pressurisation of the paste within the space 94 causing paste to be expelled through the tube 116 to the upper region of the cap 82. Release of the button causes the flexible diaphragm 110 to rise with the rising member 116 and this causes the piston 102 at the lower end of the sleeve 114 to rise in sympathy. Continued pumping of the button results in the contents of the space 94 being progressively transferred through the head and nozzle 84.

The lower edge of the tubular member 116 may be sharpened so as to pierce out the thin central area of the diaphragm as the refill 114 is fitted.

Figure 6A:
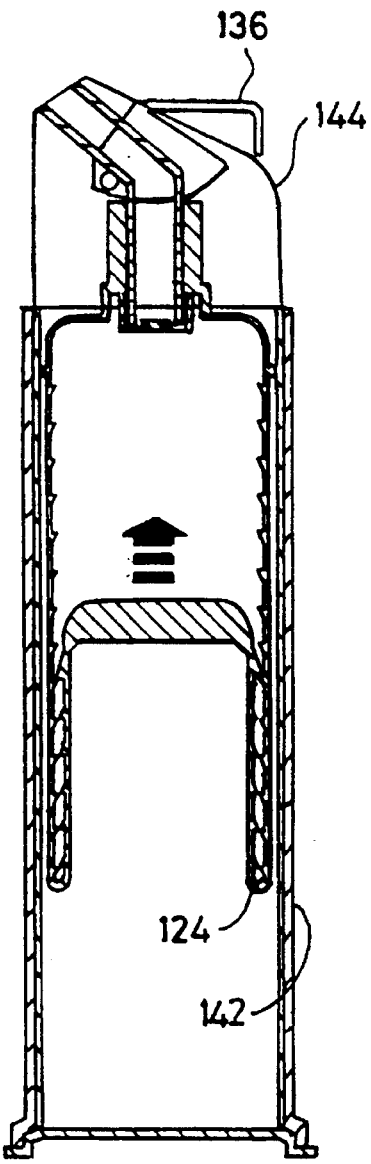
Figure 6C:
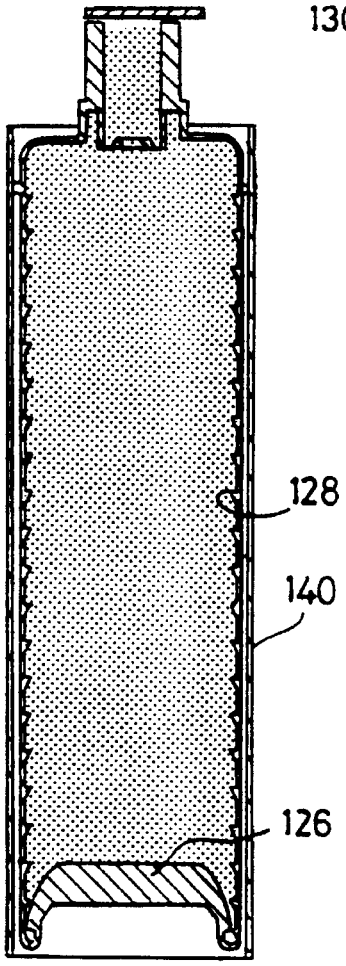
Figure 6B:
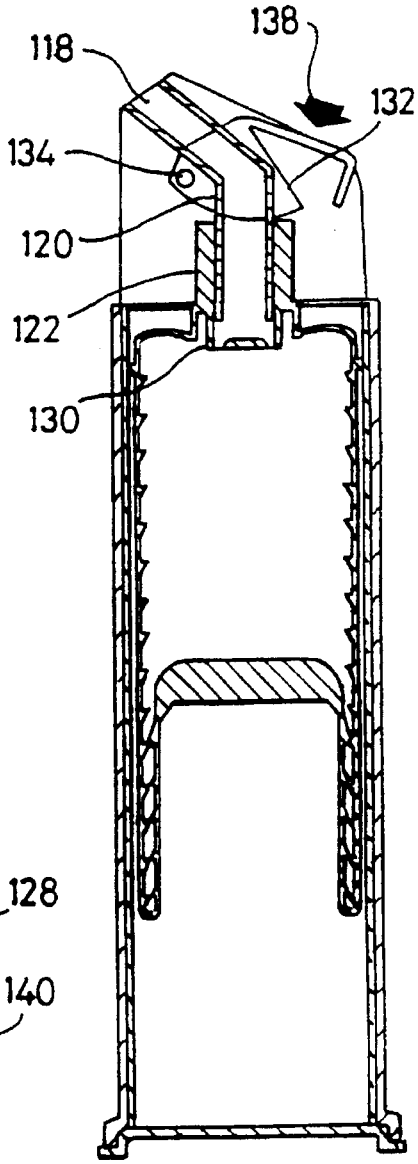

FIG. 6 illustrates an altogether different arrangement. The dispenser head in this arrangement includes a discharge passage 118 up through which paste can be discharged. The lower section of the passage comprises a generally vertical tube 120 around which a generally rigid thick walled sleeve 122 is fitted, the sleeve forming the upper end of a rolling diaphragm sachet generally designated 124. The base of the latter 126 is also formed from semi-rigid thick walled section and the internal surface of the sachet is formed with annular ribs in the form of ratchet teeth one of which is designated by reference numeral 128 in FIG. 6C. As paste is withdrawn from the sachet 126, the base 126 rises upwardly as shown in FIGS. 6A and 6B so as to conform he internal volume of the sachet to that of the paste remaining therein, and the interaction of the ratchet teeth rings is such that whilst the base can move upwardly it cannot move in a downward direction.

A non-return valve is incorporated in the upper end of the sachet by forming a window in the wall 130 which in the upper position shown in FIG. 6A is closed off by the solid wall of the tube 120 but in the lowered position of FIG. 6B is clear of the tube 120 so as to permit the flow of paste therethrough into the tube 120.

Movement of the tube 122 in a downward direction is achieved by a cam 132 which can be rotated about a pivot pin 134 with downward pressure on a button 136 in the direction of the arrow 138 in FIG. 6B. Natural resilience of the rubber diaphragm forming the shoulder at the upper end of the sachet 124 provides a restoring force although if necessary spring means may be incorporated to assist this.

Depressing the button 136 not only opens the non-return valve but also depresses the shoulder diaphragm at the upper end of the sachet 124 which produces the requisite increase in pressure in the paste to force some of the paste out of the sachet through the non-return valve into the tube 120 and through the exit nozzle 118.

Since the sachet is a relatively flimsy and easily damaged article, the refill is typically supplied in a cardboard or plastics tube such as shown in FIG. 6C at 140 and this may for example be left in place as the sachet is inserted into the outer sleeve 142 attached to the head 144 containing the exit nozzle 118 etc.

A similar dispenser is shown in FIG. 7 in which the rolling diaphragm sachet or cannister 124 includes a different upper end adapted to be fitted to an alternative discharge head generally designated 146. This housing includes a discharge nozzle 148 up through which paste can be forced with downward pressure in the direction of the arrow 150 on the platform 152.

The housing 146 includes a cylindrical outer shell 154 which is slidable within a cylindrical opening in a cylindrical shoulder 156 at the upper end of the cylindrical outer sheath or sleeve 158. Centrally within the housing 146 is a downwardly extending spigot 160.

The upper diaphragm end of the refill includes a central outlet tube formed integrally therewith and designated by reference numeral 162 the upper end of which is formed with a much reduced wall thickness and is comprised of a thin walled rubber tube dimensioned to resiliently grip the spigot 160 and close off the passage through the tube 162. Depression of the housing 146 into the condition and position shown in FIG. 7B results in an increase in pressure within the paste in the sachet since the base 126 (wherever it is positioned) is prevented from moving in a downward direction. The downward movement of the housing 146 thus causes the thin walled tube 164 to expand and allow paste to pass through the annular gap so formed. The space into which the paste passes communicates with nozzle 148.

The upper diaphragm end also includes an upstanding cylindrical wall section 168 which sealingly engages a complementary cylindrical rigid wall 170 within the housing 146.

Figure 7A:
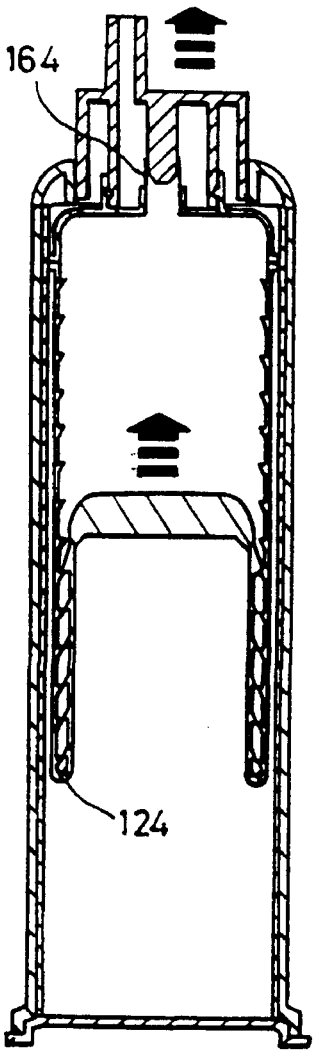
Figure 7C:
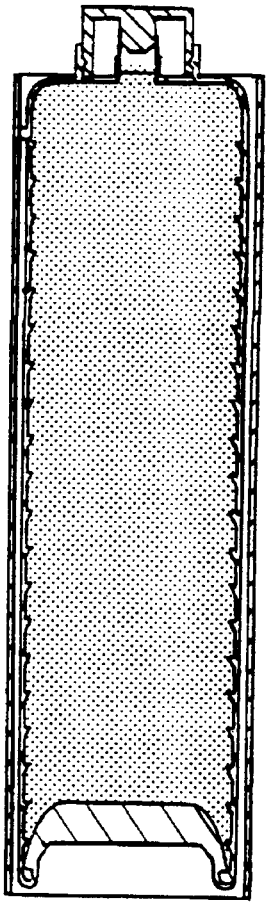
Figure 7B:
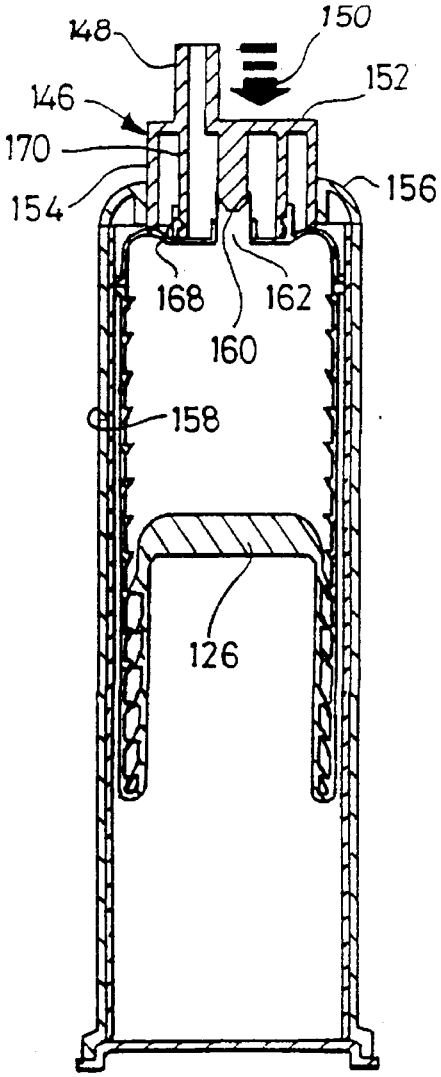
Figure 7D:
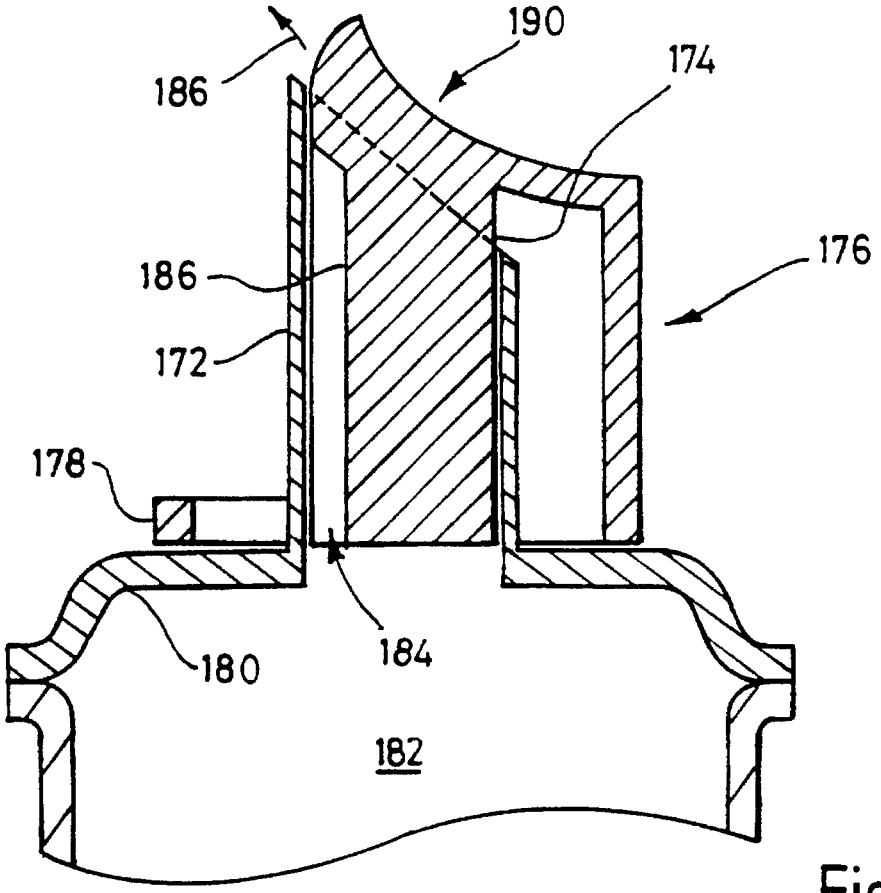
Figure 7E:
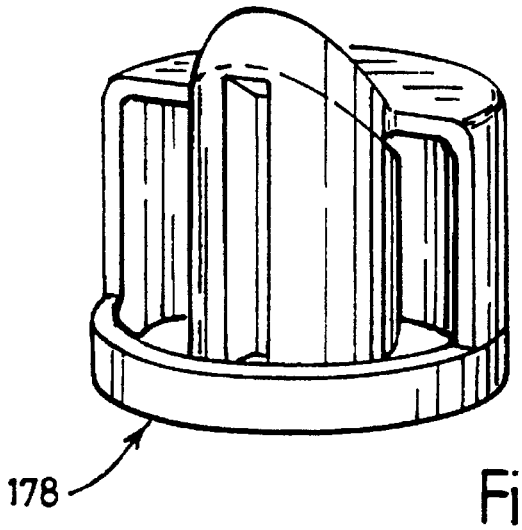

An alternative and improved discharge nozzle and integral non-return valve is shown in FIGS. 7D and 7E. In this arrangement the central tube 162 is replaced by a thin walled sleeve 172 which sealingly grips a central spigot 174 within a moulding generally designated 176 and better seen in FIG. 7E. The lower region of the moulding represents a continuous circular ring generally designated 178 which can press down on the deformable diaphragm end 180 of the refill sachet, generally designated 182. As the end 180 is pushed in a downward direction, so the contents of the sachet becomes pressurised and paste or other fluid within the sachet is forced in the direction of the arrow 184 into the narrow channel 186 formed in the outer surface of the central spigot 174. Increasing the pressure within the paste results in deformation of the upper end of the sleeve 172 in the region of the upper end of the channel 186 allowing paste to pass between the sleeve 172 and the upper end of the moulding 176 to exit in the direction of the arrow 188.

It is an advantage of the device shown in FIGS. 7D and 7E that the exit nozzle is closed at the outlet end thereof, thereby preventing the air (or other contaminating substance) from coming into contact with the non-dispensed material remaining in the passage 186.

The upper surface of the moulding 176 is formed with a curved depression generally designated 190 to facilitate the operation of the housing by the thumb.

FIGS. 8A to 8D illustrate a completely different dispensing device constructed in accordance with the second aspect of the invention. Here a sachet shown in FIG. 8C and denoted by reference numeral 192 is inserted into a shallow tray housing 194 to lie therein on top of an uncurled and generally flattened Tensator spring 196 shown in its fully distended condition in FIG. 8B. The Tensator spring is unwound and flattened by sliding an upper housing member 198 to the right so that the claw end 200 uncurls the spring 196 and retains the uncoiled end up against the corresponding end stop 202 formed by the end wall of the tray housing 194.

Figure 8A:
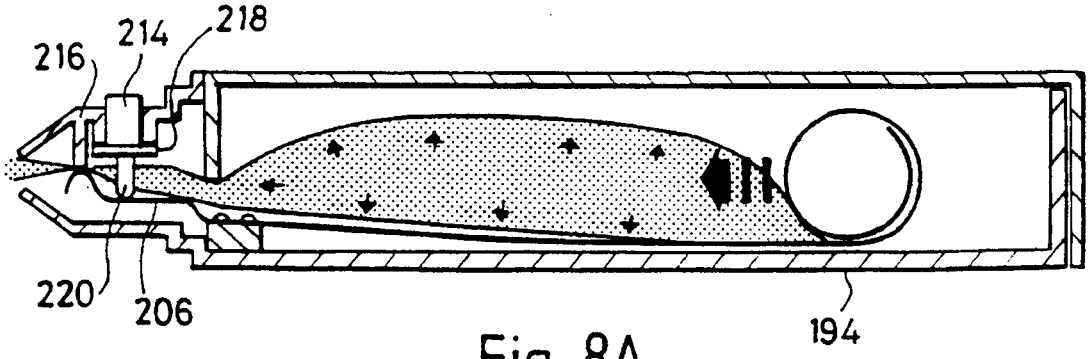
Figure 8B:
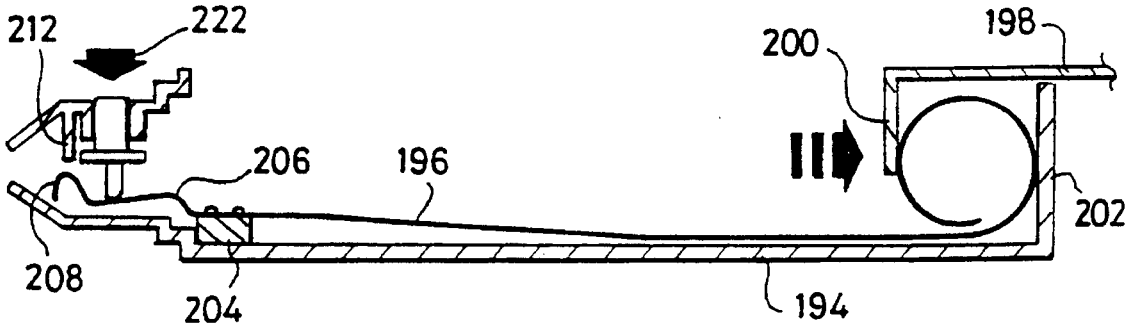
Figure 8C:
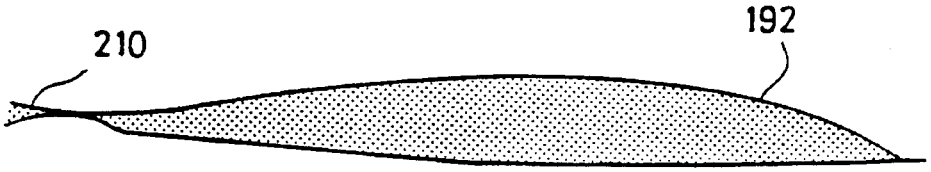

At the opposite end of the tray housing 194 the otherwise free end of the Tensator spring is secured to the base at 204 as by heat staking or riveting, and the free end of the spring therebeyond, denoted by reference numeral 206, is formed into a movable anvil 208 over which the discharge nozzle end 210 of the sachet is laid as the latter is installed. A fixed anvil 212 is formed in a bridge at the front end of the housing 194 and the resilience of the spring material 206 is such that the movable anvil 208 is resiliently biased towards the underside of the anvil 212 so as to nip the sachet therebetween as is shown in FIG. 8A. A button 214 is slidably received within the bridge 216 and includes a stop 218 preventing the button from leaving the slot within which it is vertically displaceable. Below the stop 218 the button is bifurcated so as to extend downwardly to engage the spring section 206 on either side of the discharge nozzle end 210 of the sachet 192, one of the prongs of the bifurcation being designated 220 in FIG. 8A.

Pressure on the button in the direction of arrow 222 (see FIG. 8B) results in the Tensator spring and thereby the movable anvil being depressed clear of the sachet thereby freeing the end and allowing paste to pass therethrough.

Pressure in the sachet is maintained by means of the Tensator spring 196. This is freed by sliding the housing part 198 to the left, into the position shown in FIG. 8A, so that the unrestrained end of the Tensator spring can coil up until it is prevented from further left hand movement by compression of the sachet 192. As paste is expelled from the sachet in use, so the Tensator spring is able to coil up more and move further to the left hand end, so compensating for the reducing volume of paste, but all the time maintaining a good positive pressure in the remaining paste within the sachet.

The spring force exerted by the movable anvil 208 so as to close off the passage of paste is selected so as to be sufficient as to prevent creep of the paste through the exit nozzle under the continual action of the Tensator spring derived pressure.

Figure 8D:
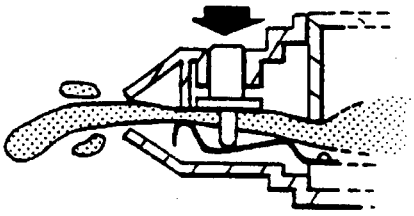

FIG. 8D shows to an enlarged scale the front end of the dispenser with the button in the depressed condition thereby allowing paste to exit from the dischage nozzle.

Figure 9B:
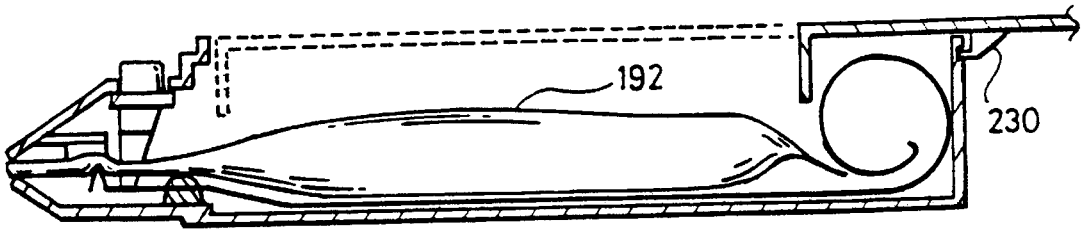
Figure 9A:
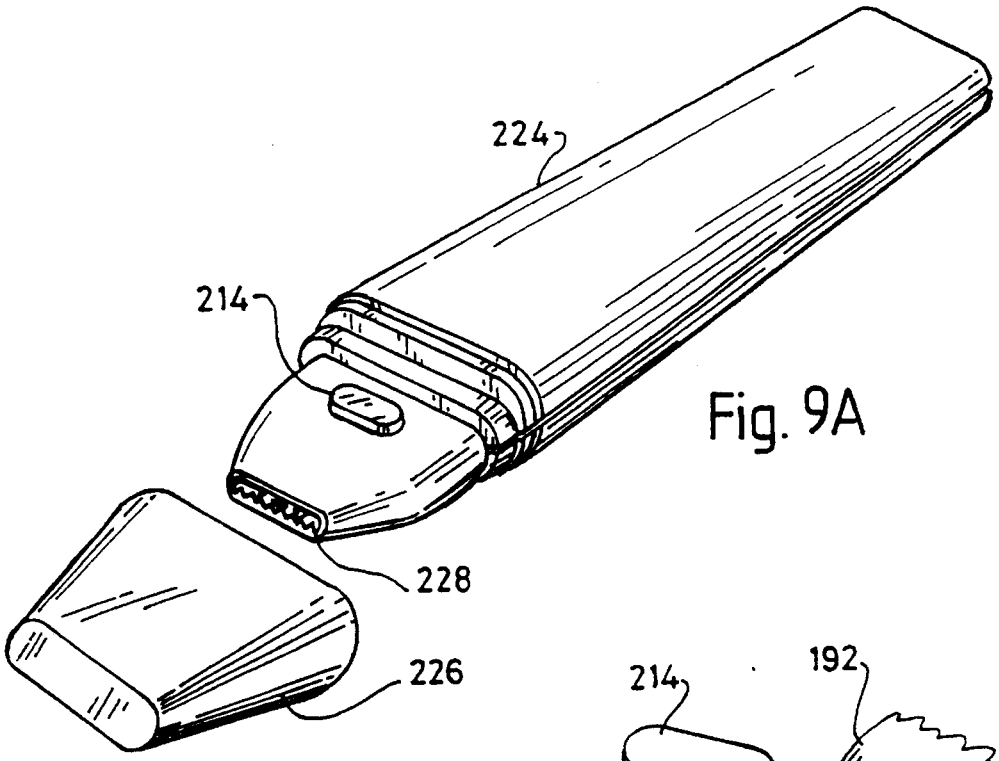

FIG. 9 illustrates how the embodiment of FIG. 8 can be incorporated into the conveniently shaped housing 224 having an end closure cap 226 which not only serves to protect the discharge nozzle 228 but also prevents the button 214 from being accidentally depressed. The cap 226 is conveniently a snap fit onto the end of the housing 224.

As shown in FIG. 9B a catch 230 may be provided on the underside of the upper housing member 198 so that when the latter has been drawn to the extreme right hand end it can be retained in position whilst the spent sachet is removed and a fresh filled sachet is inserted.

Figure 9C:
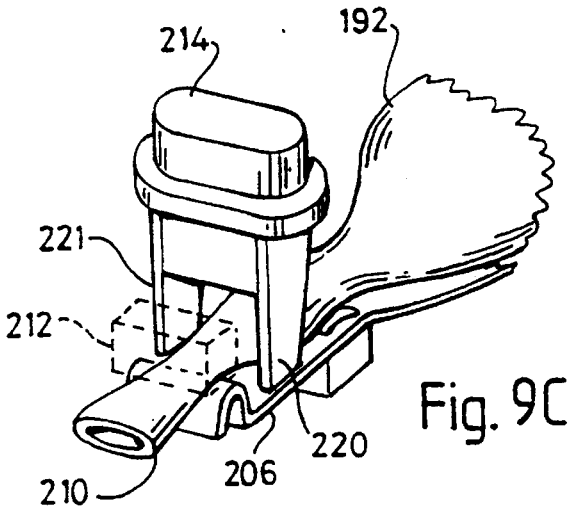

FIG. 9C illustrates to an enlarged scale the configuration of the button 214 and the bifurcated lower end having two forks 220 and 221 which extend downwardly either side of the discharge nozzle end 210 of the sachet 192 and engage the upper face of the protruding Tensator spring section 206. The stationary anvil 212 is shown in dotted outline above the sachet discharge nozzle end 210.

Figure 10A:
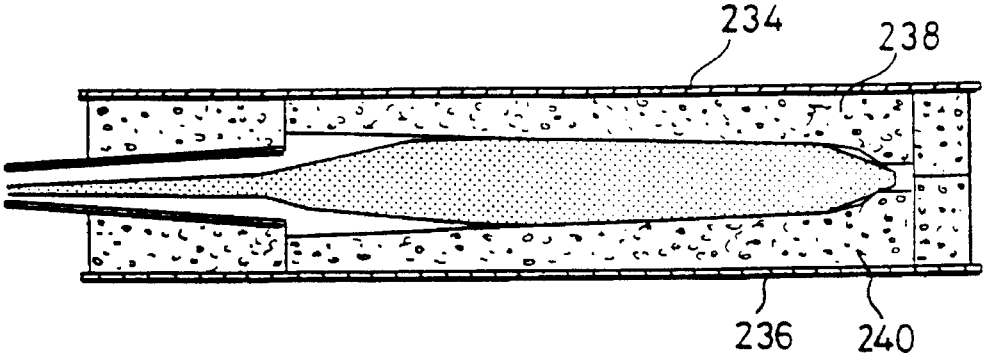
Figure 10B:
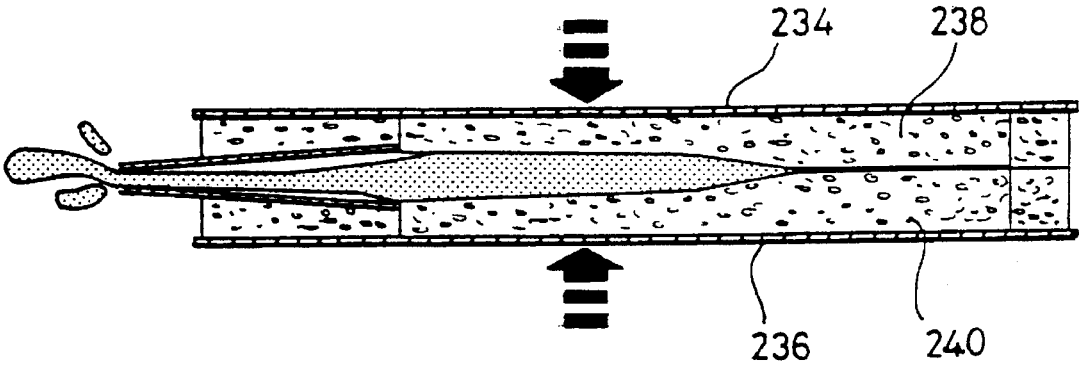
Figure 10C:
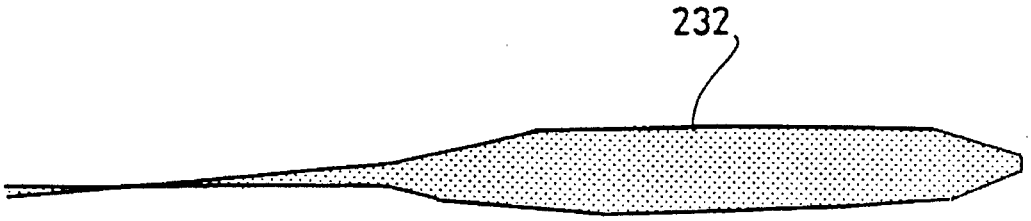

FIG. 10 illustrates the principle behind a further embodiment of the invention in which a sachet shown at 222 and containing paste such as toothpaste, can be fitted into a housing formed by two semi-rigid or rigid shells 234 and 236, each containing foamed material denoted by reference numerals 238 and 240 which is shaped and/or made more dense at the right hand end relative to the left hand end as shown in the drawing, so that as the two shells 234 and 236 are squeezed together, the contents of the sachet 232 is squeezed to a greater extent at the closed right hand end of the sachet than the other left hand end and the sachet will be progressively emptied with continued squeezing of the two shells 234 and 236 beginning from the right hand closed end of the sachet. The discharge end may be sealed until the sachet is in position and ready to be used.

After the sachet 232 has been inserted into the housing formed by the members 234 and 236, the extreme left hand end can be severed so as to provide n opening through which the contents of the sachet can be expelled.

FIG. 11 illustrates in greater detail the housing construction for the embodiment which is shown diagrammatically in FIG. 10. The housing is formed like an attache case with a base 236 and an openable upper section 234 which is hinged along a common edge of the housings by means of a polypropylene or the like hinge 242.

Figure 11A:
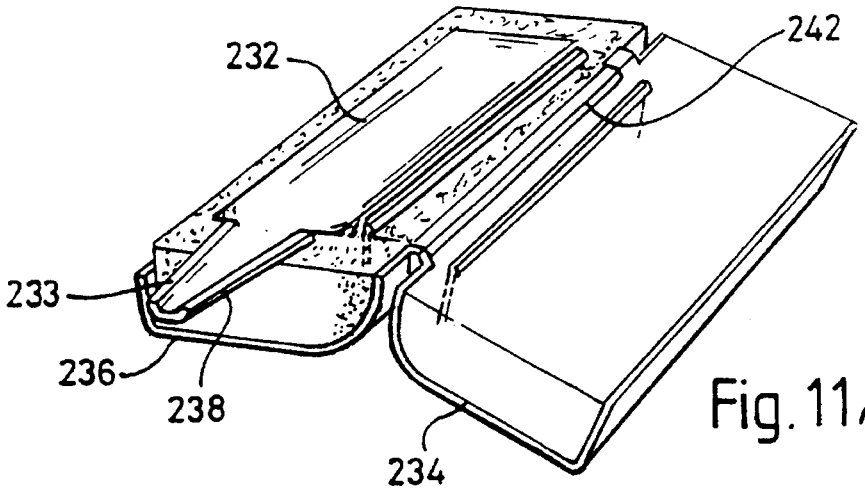
Figure 11B:
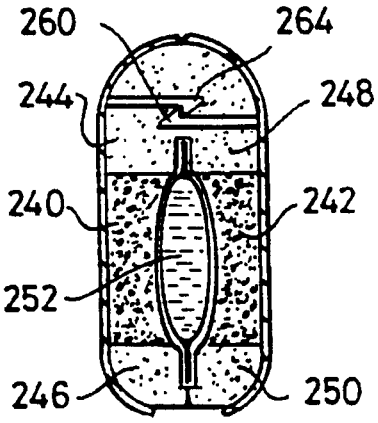

The upper and lower housing sections are fitted internally with foamed materials of differing density, and a semi-rigid foam, nozzle section, for supporting the tapering exit nozzle of the sachet 232, is provided at one end of each housing half, one such section being designated by reference numeral 238. As best seen in FIG. 11B the central region which supports the filled section of the sachet in both housing parts is formed from heavy closed cell foam material as denoted by reference numeral 240 and 242. The elongate edge regions on either side of the closed cell foam material are filled with light closed cell foam material at 244, 246, 248 and 250 respectively. After the two housing parts have been closed to form the arrangement shown in FIG. 11B, further squeezing together of the parts causes the heavy closed cell foam material to squeeze the sachet 252 so as to expel paste therefrom through the exit nozzle.

Figure 11C:
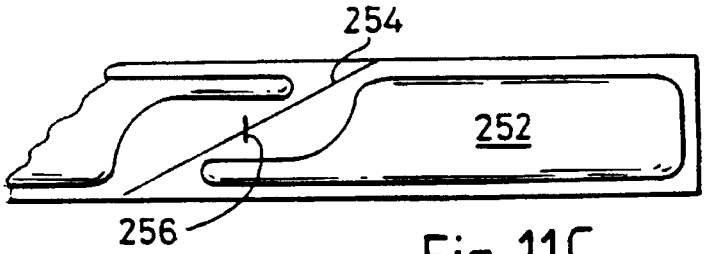

The form of the sachet is best seen in FIG. 11C which also illustrates how the sachets can best be constructed from folded blank material, by seam welding, and then cutting at an angle along the line 254. By arranging the sachets so as to be complementarily arranged along the length of the folded blank, so waste material can be reduced to a minimum.

Preferably a tear initiater cut is provided as shown at 256 in FIG. 11C, so that the extreme end region of the exit nozzle of the sachet can be removed readily when the sachet has been placed in position between two housing halves.

Figure 11D:
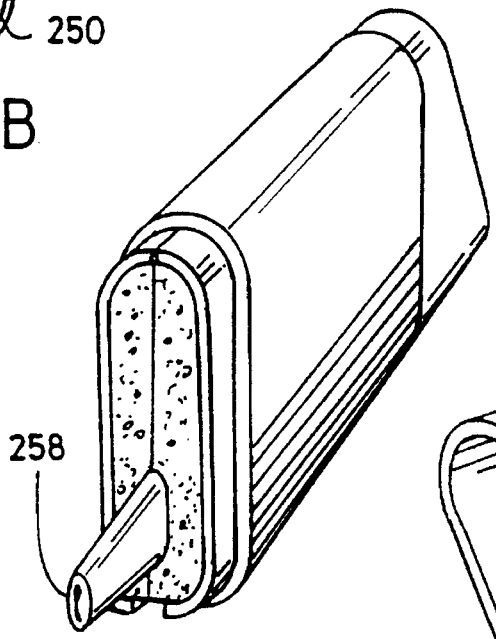

FIG. 11D illustrates the housing with the two halves generally closed together. Squeezing the two parts further together will expel paste through the exit nozzle 258. Once the squeezing action is stopped the expelling of paste ceases.

Figure 11E:
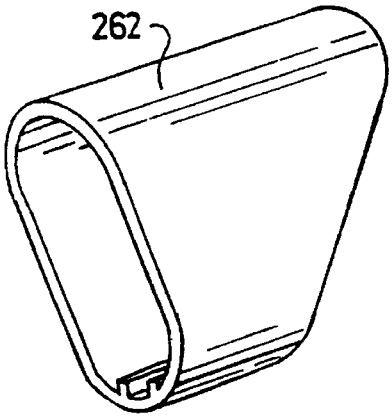
Figure 11F:
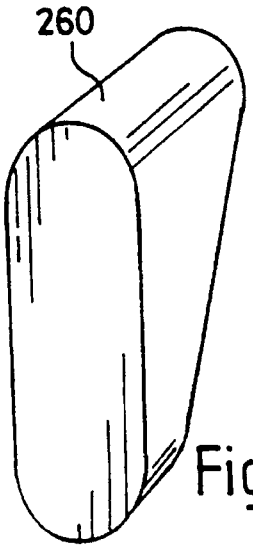

In order to prevent accidental squeezing of the casing, a protective shell can be provided as shown in FIG. 11E into which the unit shown in FIG. 11D can be slid. End caps such as shown at FIG. 11F can be fitted over the ends of the housing and the left hand end section removed when the device is to be used thereby exposing the sufficient section of the walls of the two housing parts to allow them to be squeezed together between finger and thumb to expel the desired amount of paste after which the end cover 260 can be fitted back in place. The main shell 262 shown in FIG. 11E may be shaped as shown, or as shown in FIG. 11D. The two housing parts are prevented from springing apart by means of inter-engaging catches formed on two internal walls 264 and 266 which are best seen in FIG. 11B. The engagement and position of the catches is arranged to be such that engagement occurs when the two housing parts 236, 234 are first brought together and just begin to squeeze the sachet. In that condition further squeezing of the two parts between finger and thumb compresses the foam material and in turn expels some of the paste. Releasing the pressure between the finger and thumb causes the compressed foam material to expand and force the two housing parts apart to the original position shown in FIG. 11B.

Figure 12:
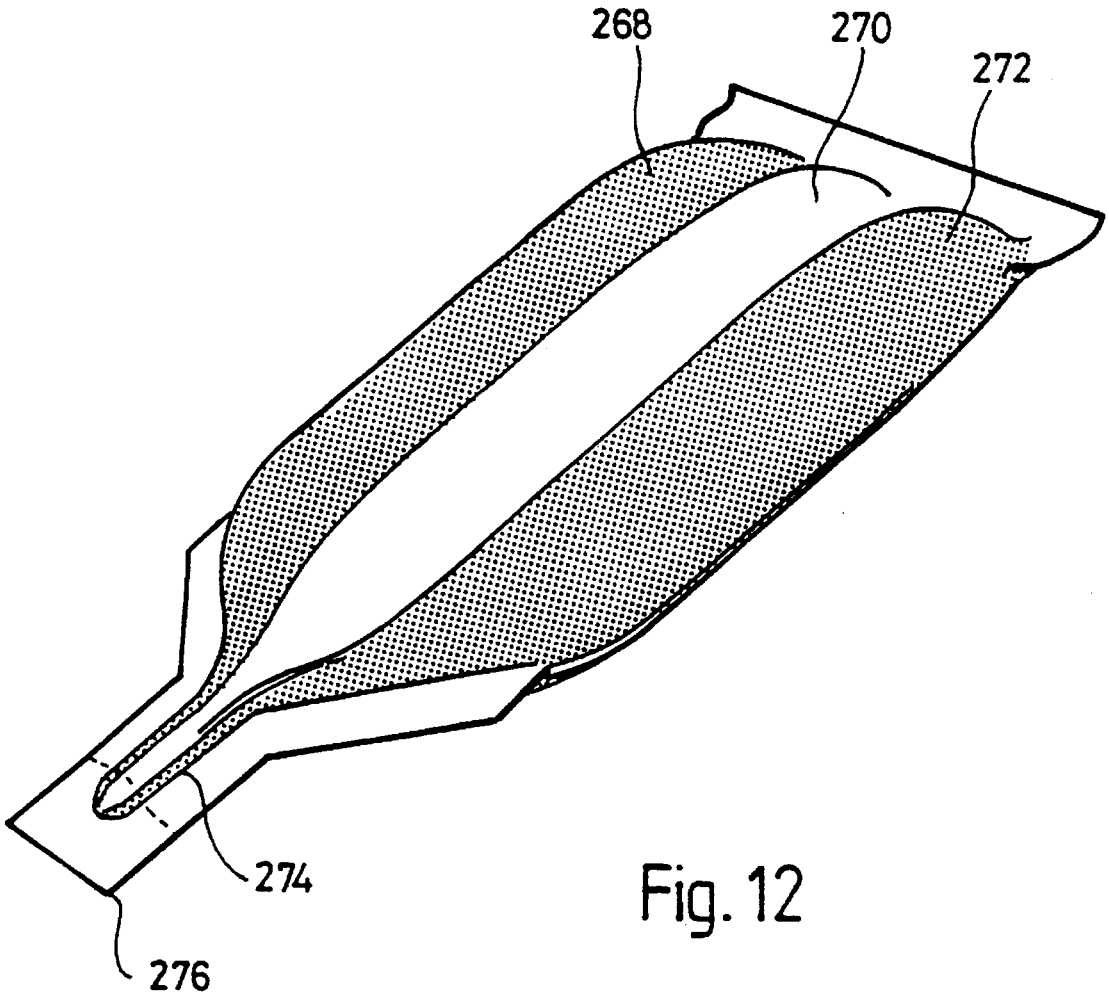

FIG. 12 illustrates a sachet which may be incorporated into the dispenser such as shown in FIGS. 8 and 9. However the sachet is now divided by means of heat sealing into three regions generally designated 268, 270 and 272. Each of the regions tapers towards the left hand exit end of the sachet and converge into a narrow circular section channel 274 which can be unsealed by tearing off or otherwise severing the extreme left hand end 276 from the remainder of the sachet. By filling the outer compartments 268 and 272 with one colour paste and the central region with another coloured paste material, so a striped effect can be produced in the extruded paste material exiting from the exit tube 274.

Alternatively three differently coloured pastes may be used to fill the three separate compartments so that a three colour striped paste extrusion is obtained.

Figure 13A:
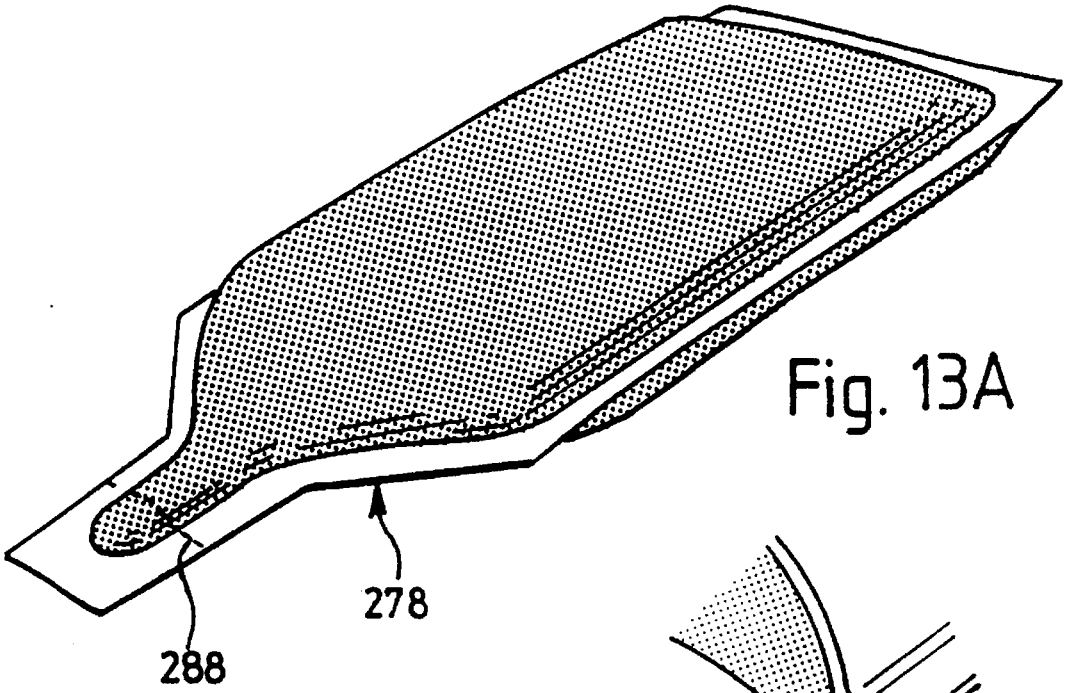
Figure 13B:
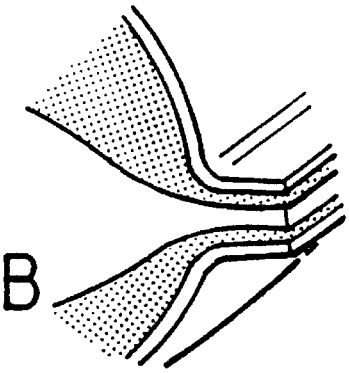
Figure 13C:
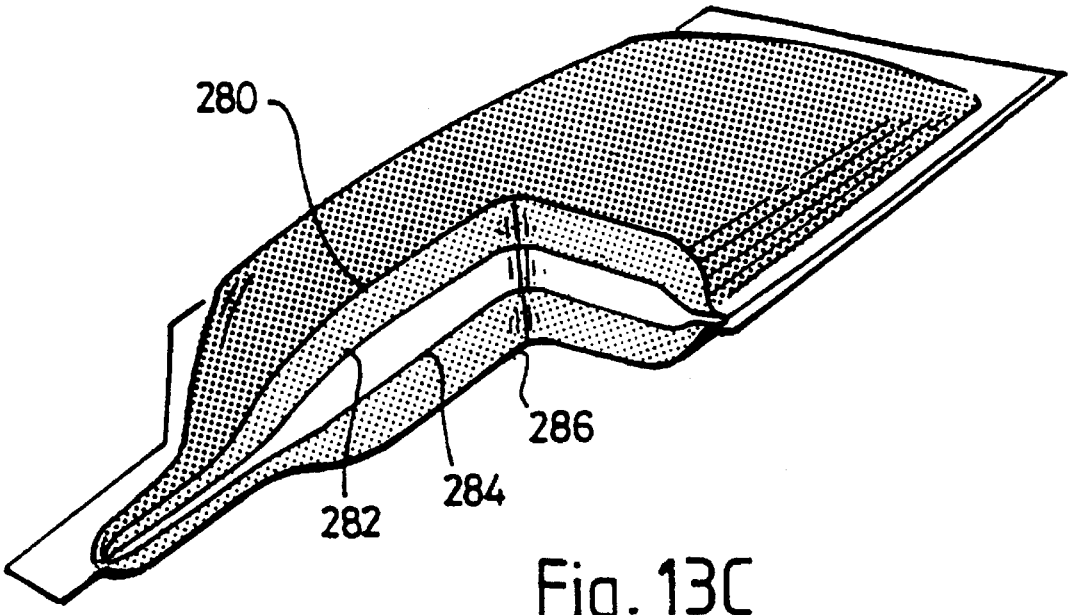

In FIG. 13 the three compartments are formed one above the other instead of side by side by edge sealing four membranes one above the other to form a complete sachet 278 as shown in FIG. 13A. The construction is more clearly shown in the enlarged scrap section of FIG. 13B whilst FIG. 13C is partly cross-sectioned and shows how differently coloured materials can occupy the three different layers defined by the four membranes, separately designated 280, 282, 284 and 286.

As before a tear initiator cut 288 may be provided to facilitate the removal of the extreme left hand end of the sachet to form an exit aperture. Also as with the arrangement shown in FIG. 12, the three compartments separately and similarly taper towards the sachet exit and merge into a single cylindrical passage which when severed along the line 288 allows each of the three materials to be extruded in parallel, provided relatively uniform pressure is applied across the width of the sachet and is progressively moved towards the exit end, as would be achieved for example by means of the curling up Tensator spring employed in FIG. 9B.

FIG. 14 shows how a plurality of differently coloured paste pencils extruded from a multihead die and denoted by reference numerals 290, 292 etc can be wrapped using a thin foil 294 so as to be separated one from the other along their length. The wrapped package may be inserted into a cylindrical sleeve such as 296 as indicated by the diagrammatic arrow 298. The wrapped package can then be fitted within a single element sachet and may if desired be generally flattened into a more eliptical format so that the pairs of darker coloured pencils of paste are located one on either side of a central pair of lighter coloured paste.

The integral nature of the sachet 300 simplifies its construction and as before a tear initiator cut 302 is provided to enable the extreme left hand end 304 to be removed to reveal the aperture through which the separately wrapped pencils of paste are simultaneously extruded when pressure is applied in an appropriate manner to the opposite end of the sachet.

Figure 15A:
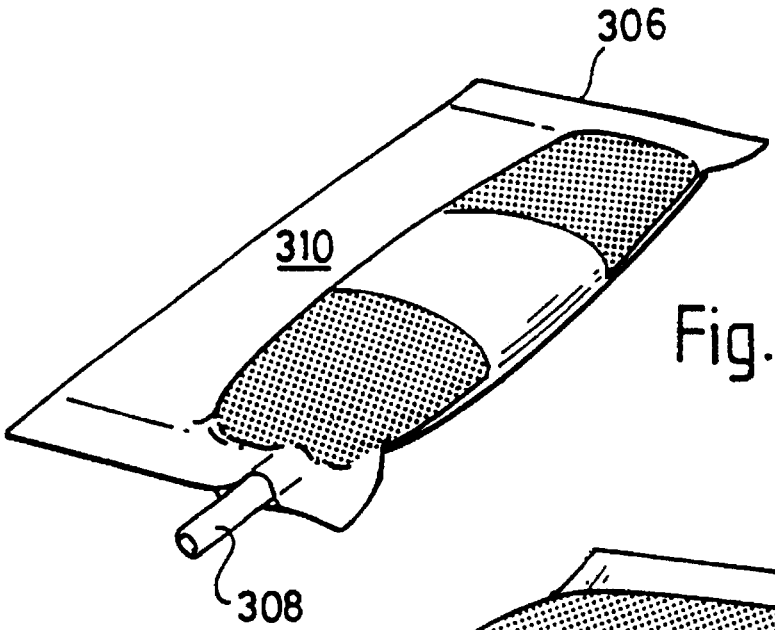

FIG. 15 illustrates a still further form of multi-component sachet in which the three compartments are arranged one after the other along the length of the sachet 306 as shown in FIG. 15A. The compartments communicate separately with a common exit manifold 308. The latter may comprise a tube extending the length of the sachet and protruding therefrom as shown, with three holes of differing sizes in the tube so as to compensate for the differential back pressures and allow design proportions of the different materials to exit simultaneously through the exit tube 308 if pressure is uniformly applied over the length of the sachet but in a manner so as to progress widthwise thereacross.

Although not shown the exit manifold may alternatively comprise three separate passages formed for example in a generally flattened region of the sachet (such as is shown in FIG. 15A at 310), each of the passages including a right angle bend so that the three passages end up as a parallel spaced array along the length of the sachet. The passages terminate in a common exit manifold (not shown) so that as the sachet is squeezed, so all the three exit passages fill with respective pastes which are conveyed to the single exit aperture to produce a striped extrusion, if the pastes are differently coloured.

Figure 15B:
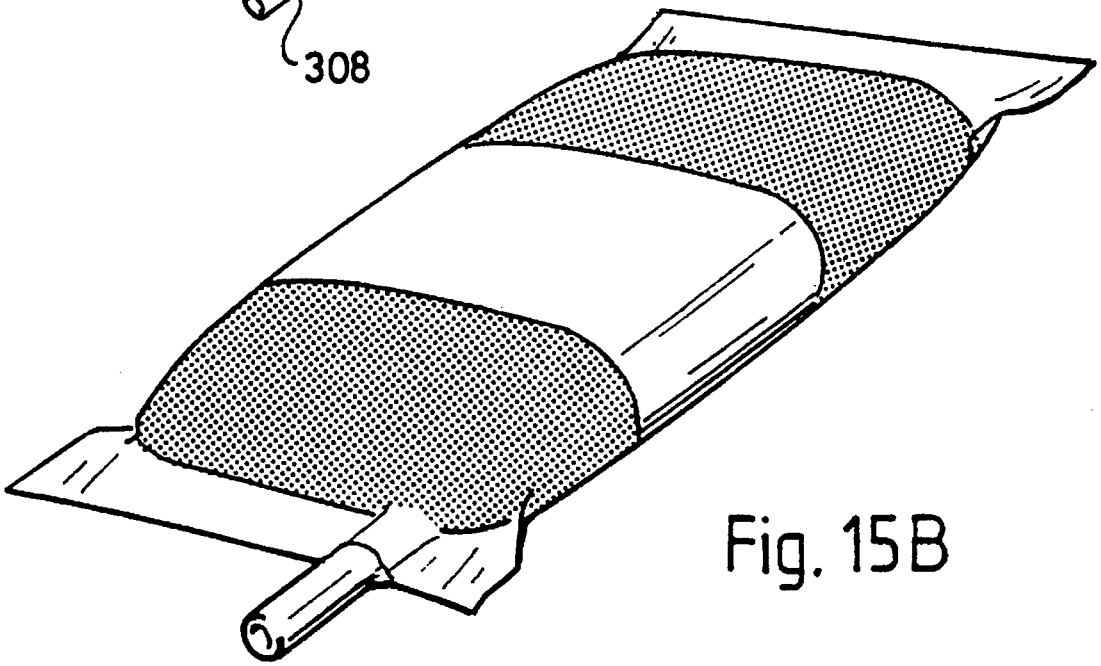

FIG. 15B shows the sachet shown in FIG. 15A fully filled.

FIG. 16 shows an embodiment of fluid delivery system in accordance with the invention, analogous to the dispenser hitherto described with reference to FIG. 8. In this drawing:

FIG. 16A is a diagrammatic side view of a fluid delivery system embodying the invention for discharging the contents of a sachet;

FIG. 16B is an end view of a housing containing the mechanism of FIG. 1 with the rotatable retraction handle in its stowed position;

FIG. 16C is a scrap view of the upper end of a sachet showing the support strip and needle aperture;

FIG. 16D is a scrap view showing how the nozzle can be tilted to permit the insertion of a new sachet;

FIG. 16A is a side view of a fluid discharge system in which a sachet 410 is compressed by Tensator spring 412 so as to pressurise the contents of the sachet for discharge through an exit aperture 414 in a spring head 416. The Tensator spring is retracted by means of a bifurcated arm 418 having a threaded hub 420 at its end remote from the spring in which a correspondingly threaded pin 422 is received having a handle or head 424 by which it can be rotated. Turning the pin in an appropriate sense will draw the bifurcated member 418 down the thread profile thereby unrolling or retracting the spring 412.

A base 426 which includes an anchorage 428 for the fixed end of the spring 412 also includes an end plate 430 having a cup 432 for receiving the inboard end of the pin 422. The plate also has an appature 434 so that after the threaded pin 422 has been unscrewed and tilted, it can be pushed through the appature 434 in between the underside of the Tensator spring 412 and the base for storage.

The presence of a filled sachet 410 prevents the Tensator spring from rolling up except as the contents of the sachet are discharged. However, the bifurcated end of the arm 418 allows the arm to be pushed forwardly over the sachet for storage purposes.

The sachet is normally formed from plastic sheet material and is seam welded and is most simply apertured to enable discharge of its contents to be effected by means of a hypodermic type needle 436 protruding from one side of the spray head 416. By impaling the taut plastic sheet material of the sachet against the sharp end of the needle, so the latter will penetrate the sachet and the contents of the sachet can pass through the hollow needle into the spray head 416.

Depending on whether the sachet includes a fluid which is to be dispensed as a fine mist or spray or a cream or a gel, so the interior of the spray head will be designed accordingly so as to achieve the appropriate droplet size or foaming or appropriate consistency of the product as it exits from the aperture 414, The spray head 416 is typically pivotal about a pivot pin 438 and includes a locking protrusion 440 which extends through an aperture in the inboard end plate 412 of the base 426. As shown in FIG. 16D, provided the inboard end of the bifurcated arm 418 is not in its stowed position which prevents the spray head from pivoting, the latter can be pivoted to permit the insertion of a filled sachet 410 into the upper region where it is to be impaled by the hypodermic needle 436. Tilting the spray head back into its upright position causes the needle to penetrate as described.

By providing an over centre action of the pivot, so the spray head will tend to remain in the upright position shown in FIG. 16A.

Engagement of the protrusion 440 in aperture 444 in the inboard end of the arm 418 prevents the tilting as shown in FIG. 16D and locks the spray head in position.

In order to seal the opening formed by the needle and also to provide protection around the sharpened end of the needle when the spray head is in the tilted position of FIG. 16D, a block of elastomeric material is provided around the needle and although not shown a backing plate may be provided on the opposite side of the sachet so that the latter is squeezed between it and the elastomeric material 446.

FIG. 16B is an end view showing how the component parts fit together within an octagonal housing. FIG. 16B also shows the handle 424.

The core roller 448 around which the spring is wound is carried by a steel shaft 450 and it is the steel shaft which is engaged by the bifurcated end of the arm 418.

A further refinement to the sachet is the provision of a moulded or otherwise formed support strip or bridge 452 at the upper end of the sachet having a hole 454 through which the needle can protrude. The bridge 452 is bonded to the surface of the sachet or otherwise formed integrally therewith so as to seal around the hole which will be made by the needle and the elastomeric material 446 is arranged to seal against the bridge 452 instead of the surface of the sachet.

The spray head 460 preferably includes two laterally protruding lugs 456 and 458, one of which is visible in FIG. 16A, which as the spray head is rotated into its upright position of FIG. 16A, engage opposite edges of the ridge 452 to locate the same in position.

FIG. 17 shows some preferred optional features for the fluid delivery system of FIG. 16.

Figure 17A:
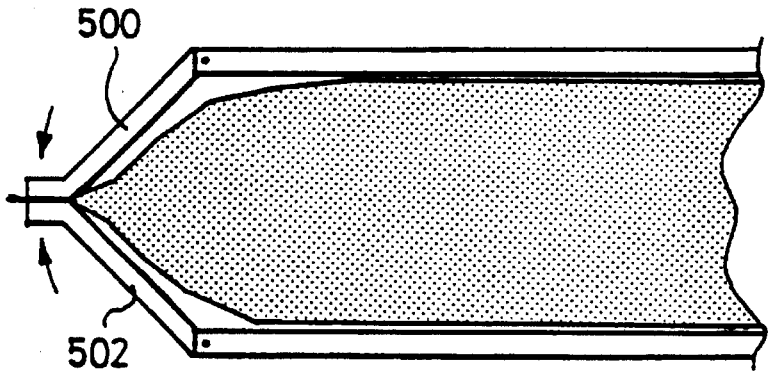
FIG. 17 serves to illustrate same preferred optional features for inclusion in the delivery system.
Figure 17A:
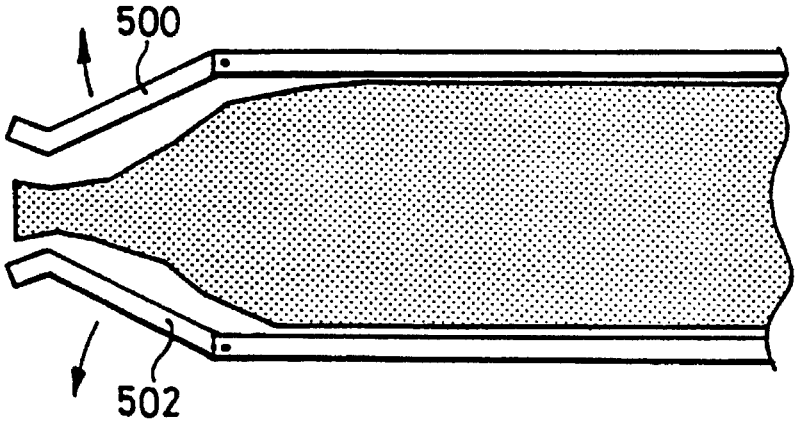

First, in FIGS. 17Aa and 17Ab, there is illustrated a preferred means for opening and closing the sachet nozzle. If the sachet mouth is opened and closed by a single moving jaw cooperating with a fixed jaw, say on the centre line of the sachet, the mouth opens into a disadvantageous "D" cross-section, while problems with recurrent spring and closing can arise if the fixed jaw does not lie on the centre line of the sachet. Thus, two moving jaws 500, 502 are preferred, as illustrated.

Figure 17B:
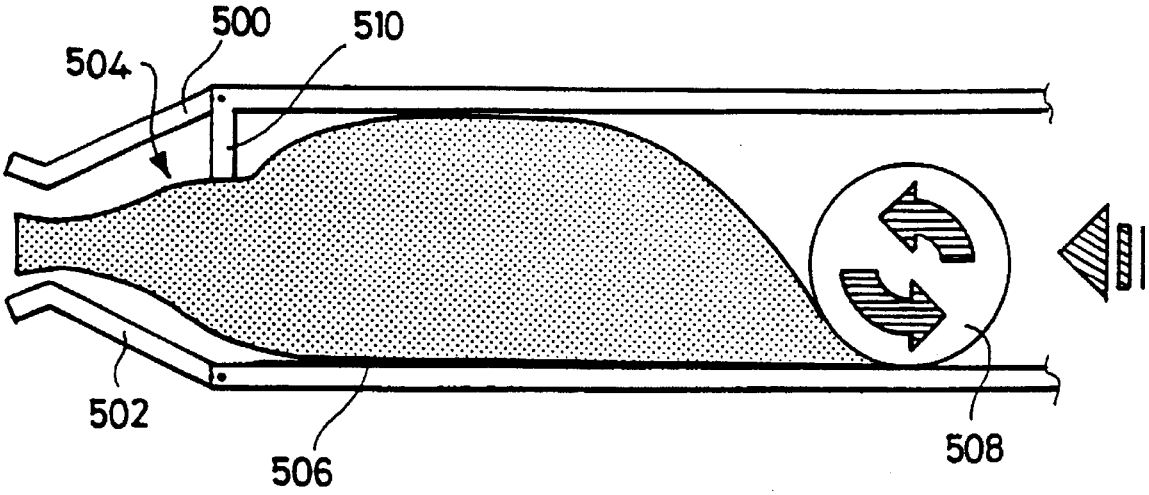

Second, referring to FIG. 17B, it can be seen that, when the jaws 500, 502 open, the socket will tend to lift at the region 504 behind the jaws, due to the fact that the Tensator spring 506 winding on the drum 508 is pulling the top wall of the socket tauter than the bottom wall. Mouth distortion can occur if the sachet lifts into engagement with the open upper jaw 500. Thus, a restraining member 510, with a saddle-shaped lower edge, is introduced, in order to prevent excessive lifting of the region 504 of the sachet.

Figure 17C:
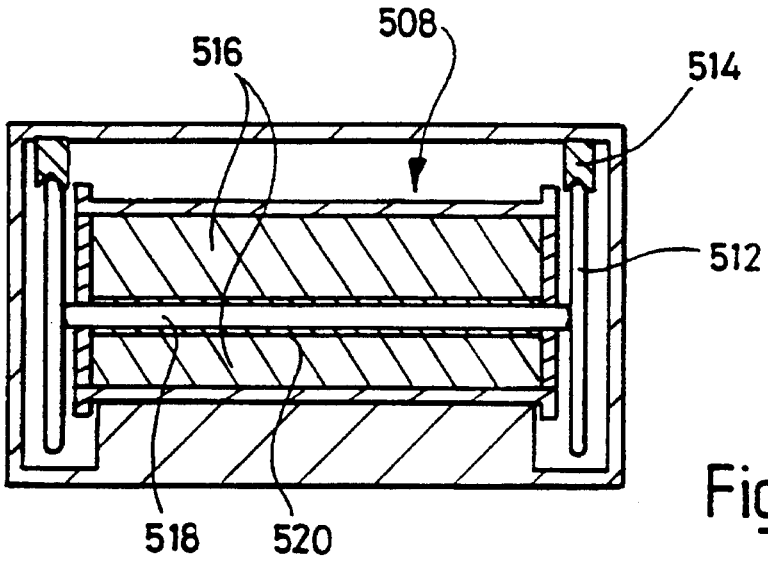

FIG. 17C shows the Tensator spring drum 508. This tends to lift when the sachet is pressurised. If it lifts sufficiently to scrape the underside of the housing the rate of dispensing will be reduced. It is therefore a possible option to fit wheels 512 with radiused peripheries to the ends of the drum 508, these wheels running in grooved guides 514 provided on the underside of the top of the housing. This arrangement also ensures that skewing does not occur as the spring rolls up. Moreover, by making the case 516 of the drum of compliant material around a central spindle 518 and bush 520, engagement of the wheels 512 with the guides 514 is reliably ensured. Another resulting advantage is that there is a downward reaction on the drum which ensures that the sachet is tightly squeezed at entry on to the drum, so that a minimum of the flowable product such as toothpaste is wasted.

Figure 17D:
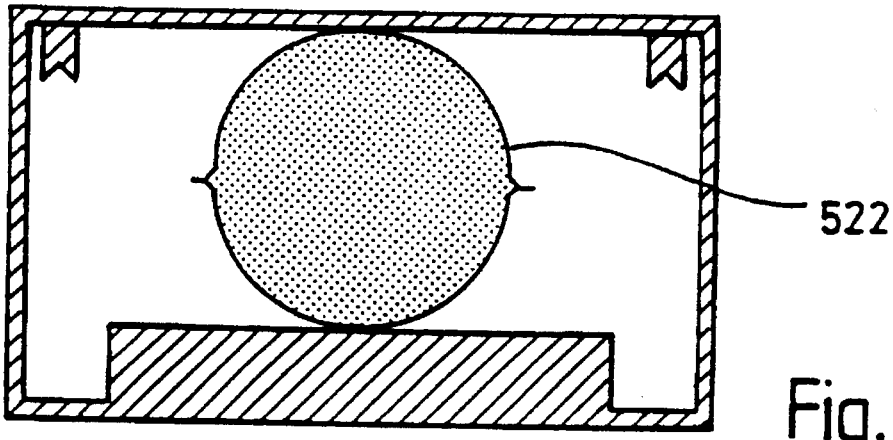
Figure 17D:
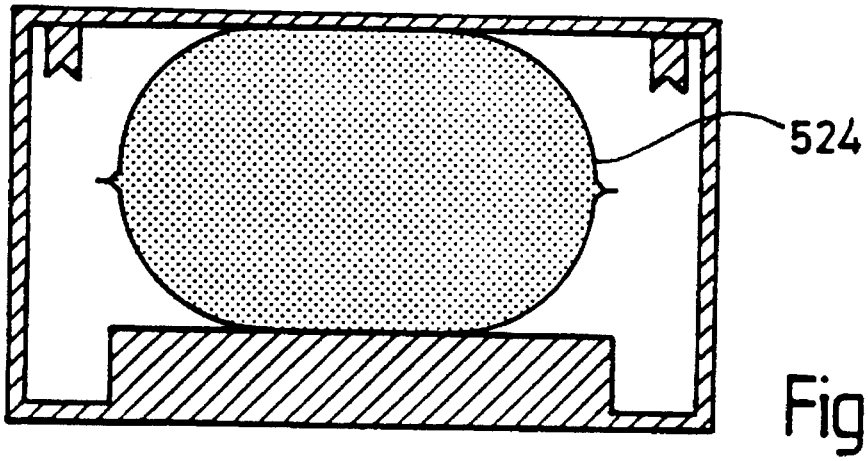

Third, FIG. 17D*a* shows a round sachet 522. For preference, however, an oversize sachet 524 (FIG. 17D*b*) is used, as this will be constrained to take up a somewhat rectangular cross-section Which better matches the rectangular shape of the flowable product.

Figure 17E:
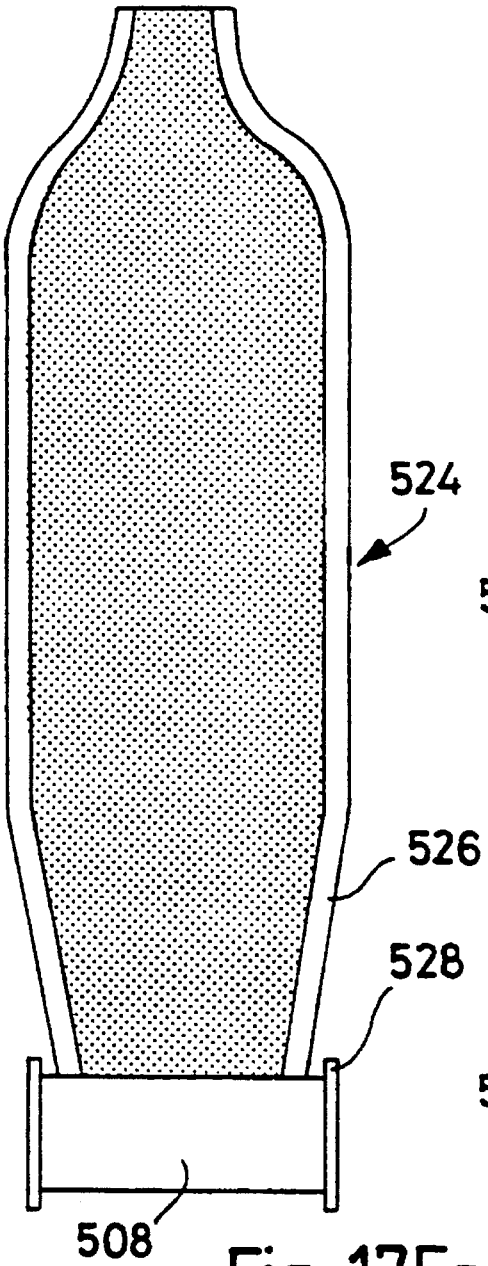
Figure 17E:
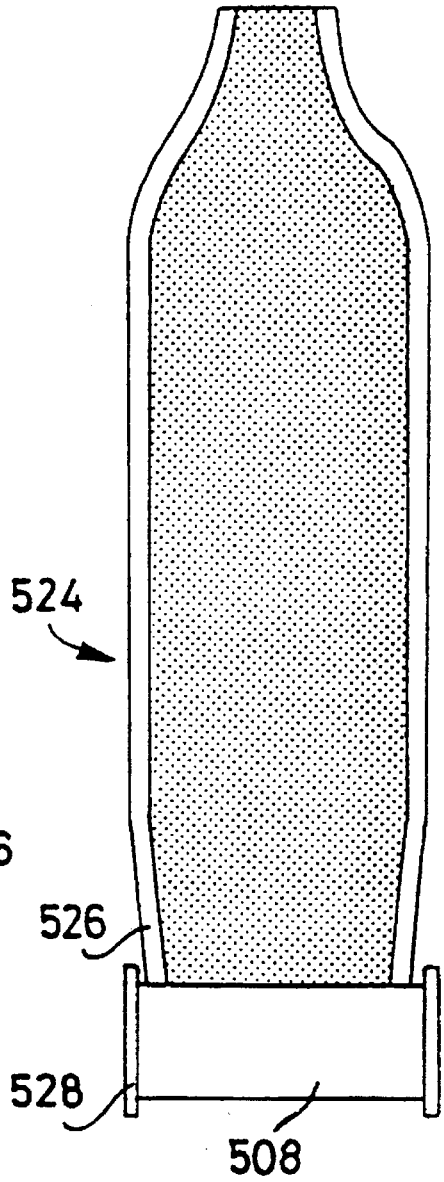

Finally, referring to FIGS. 17E*a* and 17E*b*, when an oversize sachet 524 is employed, its end remote from the nozzle is preferably tapered, as indicated at 526, and edge flanges 528 are provided on the drum 508 to guide the wider bag on to the narrower drum. FIG. 17E*a* shows the starting condition; FIG. 17E*b* shows that the sides of the sachet are pulled towards one another on the drum 508 advances, so that winding on to the drum becomes easier.

We claim:

1. A dispensing device for dispensing flowable materials comprising:

a two-part housing including a region defining a discharge nozzle, through which flowable material can pass;

support means for receiving a sachet which is initially filled with material to be dispensed, the support means serving to position the sachet relative to the discharge nozzle defining region and retain the sachet in position so that flowable material leaving the sachet exits through the discharge nozzle defining region;

means for pressurizing the contents of the sachet situated within the support means at least when discharge of material therefrom is required; and valve means for controlling the flow of material through the nozzle defining region;

the housing being openable for insertion of a flexible sachet of flowable material, and the pressurizing means comprising a self roll-up spring which in use exerts a force on the sachet to expel material therefrom through the valve means, which prevents exit of material except when it is opened;

wherein the roll-up spring is initially unrolled and expels material through the opened nozzle as it rolls up, the sachet being progressively rolled up with the spring, and wherein the two-part housing is provided with means for relatively displacing the two parts thereof in the direction in which the spring rolls up and unrolls, whereby displacing one part relative to the other opens the housing for sachet replacement and automatically unrolls the spring so that it will pressurize a replacement sachet when the housing is subsequently closed.

2. A device according to claim 1, wherein said displacing means comprises a plunger which is threaded and rotatable by means of an external handle to displace a second part of the housing relative to a first part of the housing.

3. A device according to claim 2, wherein the first part of the housing carries a sachet piercing means to establish a fluid exit from the sachet to the discharge nozzle defining region.

4. A device according to claim 3, having a finger-operable accessible element for opening the discharge nozzle defining regions.

5. A device according to claim 4, wherein the curled up end of the roll up spring is mounted on a drum which has wheels running on guides in the closed housing.

6. A device according to claim 5, wherein a core of the drum is made of compliant material to assist guiding of the drum and thereby ensure uniform compression of the sachet across its width.

7. A fluid delivery system comprising:

(a) housing means (b) a variable volume reservoir located therein (c) valve means for controlling the flow of a fluid contained within the reservoir through an outlet nozzle, (d) roll-up spring means within the housing means acting on the reservoir to pressurize the contents thereof so that when the valve means is opened the contents are forced therethrough, wherein the reservoir comprises a sachet acted on by the roll-up spring means, the housing means including retraction means for retracting the spring means to permit the insertion of a filled sachet and further including means for releasing the retraction means to enable the spring means to curl up and pressurize the sachet, and wherein the housing includes sachet retaining means remote from a curled up end of the roll-up spring means together with means for piercing the sachet and providing a fluid exit therefrom leading to said valve means and said outlet nozzle.

8. A system according to claim 7, wherein said retraction means comprises a plunger having a handle externally of the housing means which can be displaced in a rearward direction to retract the roll-up spring means, the plunger being threaded and rotatable by the handle so as to draw the roll-up spring means rearwardly within the housing to retract the spring means.

9. A system according to claim 7, having a finger-operable accessible element for opening the nozzle defining means.

10. A system according to claim 7, wherein the housing means comprises a two part housing which is openable to enable variable volume reservoir replacement.

11. A system according to claim 10, wherein the two parts of the housing are relatively displaceable in the direction in which the spring means rolls up and unrolls, whereby displacing one part relative to the other opens the housing for sachet replacement and automatically unrolls the spring means so that it will pressurize a replacement sachet when the housing means is subsequently closed.

12. A system according to claim 11, wherein the roll-up spring means has one end fixed to the first part of the housing carrying the outlet nozzle and at the other end has a curled portion engaged and displaced by the second part of the housing when the latter is displaced relatively to the first part to open the housing.

13. A system according to claim 12, wherein the first part of the housing carries a sachet piercing means to establish a fluid exit from the sachet to the nozzle defining means.

14. A system according to claim 12, wherein the two parts of the housing are relatively displaceable by means of a plunger having a handle external to the housing.

15. A system according to claim 14, wherein the plunger is a threaded plunger and is rotatable by means of the handle to displace the second part of the housing relative to the first part.

16. A system according to claim 12, wherein the curled up end of the roll-up spring means is mounted on a drum which has wheels running on guides in the closed housing.

17. A system according to claim 16, wherein the core of the drum is made of compliant material to assist guiding of the drum and thereby ensure uniform compression of the sachet across its width.

* * * * *